US009833799B2

(12) United States Patent
Minnette et al.

(10) Patent No.: US 9,833,799 B2
(45) Date of Patent: Dec. 5, 2017

(54) CONTAINER CLOSURE WITH PRODUCT-DISCHARGE CONTROL SYSTEM

(71) Applicant: Berry Plastics Corporation, Evansville, IN (US)

(72) Inventors: Jeffrey C Minnette, Evansville, IN (US); Eric W Kost, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 211 days.

(21) Appl. No.: 14/711,165

(22) Filed: May 13, 2015

(65) Prior Publication Data

US 2015/0328653 A1 Nov. 19, 2015

Related U.S. Application Data

(60) Provisional application No. 61/992,690, filed on May 13, 2014.

(51) Int. Cl.

| | |
|---|---|
| ***B05B 11/04*** | (2006.01) |
| ***B65D 1/32*** | (2006.01) |
| ***B65D 47/06*** | (2006.01) |
| ***B65D 47/20*** | (2006.01) |

(52) U.S. Cl.

CPC ..... *B05B 11/047* (2013.01); *B05B 11/048* (2013.01); *B65D 1/32* (2013.01); *B65D 47/06* (2013.01); *B65D 47/2031* (2013.01)

(58) Field of Classification Search

CPC . B05B 11/047; B05B 11/048; B65D 47/2031; B65D 47/06; B65D 1/32

USPC ..... 222/490, 494, 213

See application file for complete search history.

(56) References Cited

U.S. PATENT DOCUMENTS

| | | | | |
|---|---|---|---|---|
| 3,674,183 | A * | 7/1972 | Venable | B65D 47/2031 222/212 |
| 4,147,278 | A * | 4/1979 | Uhlig | B65D 83/0055 222/400.8 |
| 4,588,648 | A | 5/1986 | Krueger et al. | |
| 4,728,006 | A | 3/1988 | Drobish et al. | |
| 4,749,108 | A | 6/1988 | Dornsbusch et al. | |
| 4,842,165 | A | 6/1989 | Van Coney | |
| 4,983,061 | A | 1/1991 | Demarest | |
| 5,012,956 | A * | 5/1991 | Stoody | B65D 83/0055 222/206 |
| 5,213,236 | A | 5/1993 | Brown et al. | |
| 5,971,645 | A | 10/1999 | Fukushima et al. | |
| 6,371,675 | B1 | 4/2002 | Hoang et al. | |
| 8,439,212 | B2 | 5/2013 | Clodfelter et al. | |

(Continued)

OTHER PUBLICATIONS

International Search Report and Written Opinion, International Application No. PCT/US15/30568, search completed Jul. 15, 2015, 17 pages.

*Primary Examiner* — Donnell Long

(74) *Attorney, Agent, or Firm* — Barnes & Thornburg LLP

(57) ABSTRACT

A package includes a container and a closure arranged to close an opening into an interior region formed in the container. The closure includes a dispensing cap formed to include a body adapted to be coupled to a neck of the container and a product-discharge spout coupled to the body to discharge product stored in the container that passes from the interior region of the container into a discharge passageway formed in the product-discharge spout.

18 Claims, 21 Drawing Sheets

(56) References Cited

U.S. PATENT DOCUMENTS

| | | | | |
|---|---|---|---|---|
| 2003/0178445 | A1 | 9/2003 | Saifian | |
| 2007/0181522 | A1 | 8/2007 | Davidson | |
| 2009/0038545 | A1 | 2/2009 | Akaishi et al. | |
| 2009/0314856 | A1 | 12/2009 | Romanov et al. | |
| 2012/0211530 | A1 | 8/2012 | Bloom | |
| 2015/0014369 | A1* | 1/2015 | Hatton | F16K 15/147<br>222/490 |

* cited by examiner

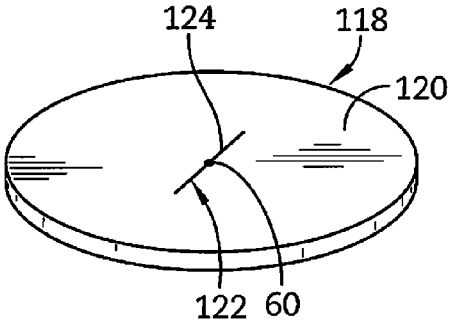
FIG. 3A
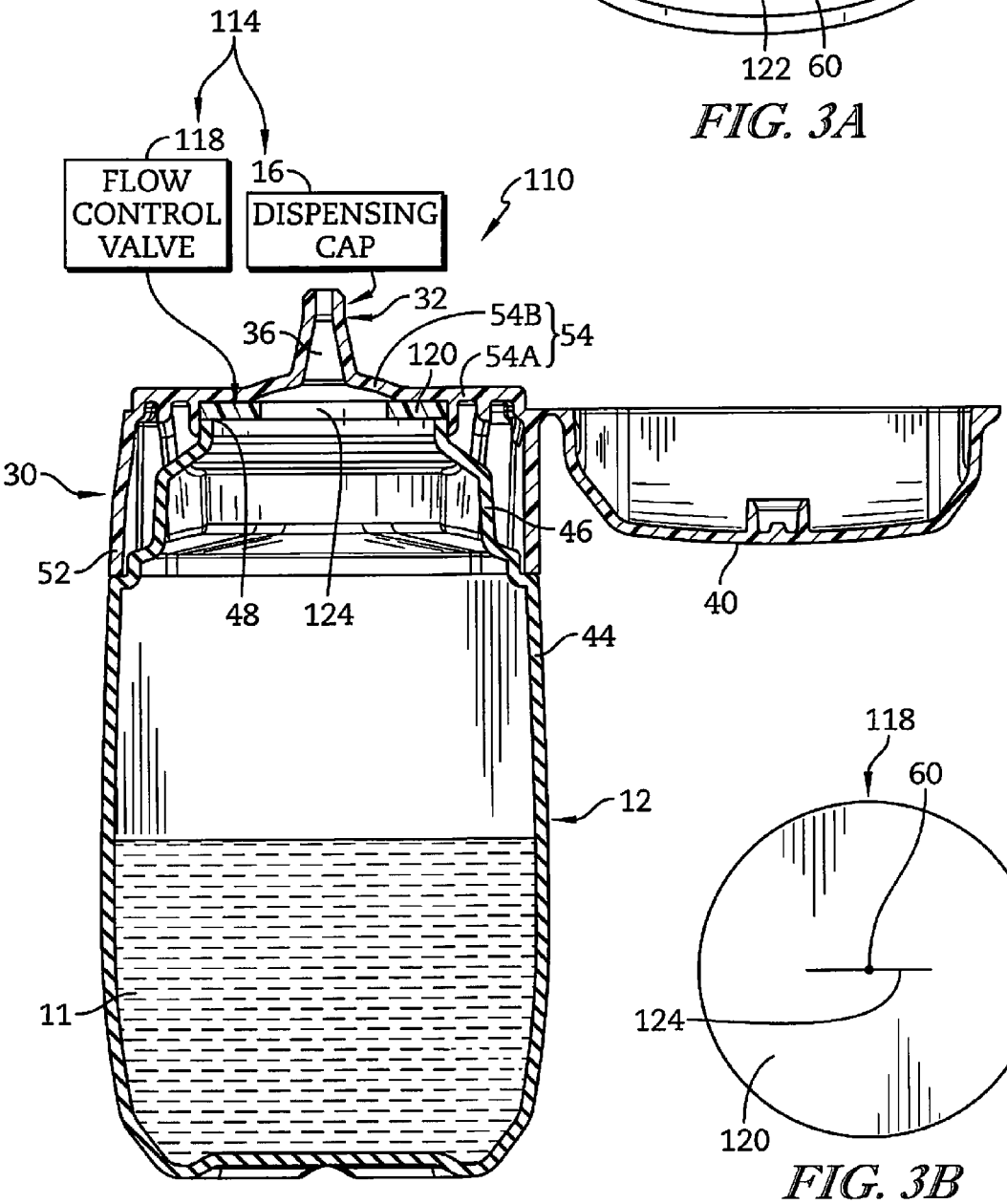
FIG. 3
FIG. 3B

CONTAINER CLOSURE WITH PRODUCT-DISCHARGE CONTROL SYSTEM

PRIORITY CLAIM

This application claims priority under 35 U.S.C. §119(e) to U.S. Provisional Application Ser. No. 61/992,690, filed May 13, 2014, which is expressly incorporated by reference herein.

BACKGROUND

The present disclosure relates to product-storage containers and particularly to containers for storing and dispensing fluid materials. More particularly, the present disclosure relates to a dispensing closure for a container.

SUMMARY

A package in accordance with the present disclosure includes a container and a closure arranged to close an opening into an interior region formed in the container. In illustrative embodiments, the closure includes a dispensing cap formed to include a body adapted to be coupled to a neck of the container and a product-discharge spout coupled to the body to discharge product stored in the container that passes from the interior region of the container into a discharge passageway formed in the product-discharge spout.

In illustrative embodiments, a pliable membrane made of film is interposed between the interior region of the container and the discharge passageway of the product-discharge spout. A slit is formed in the pliable membrane to provide a normally closed discharge aperture. The membrane is coupled either to the dispensing cap or the neck of the container to place the normally closed discharge aperture in fluid communication with the interior region of the container and with the discharge passageway of the closure. The discharge aperture formed in the pliable membrane is configured to provide means for regulating flow of fluid material from the interior region of the container into the discharge passageway through the normally closed discharge aperture in the event the container is squeezed to pressurize fluid material stored in the interior region of the container.

In illustrative embodiments, the membrane is pre-formed to include a perimeter edge adapted to mate with the container and closure and a domed center portion having a convex surface arrangement to face downwardly toward the interior region of the container and formed to include the normally closed discharge aperture. When fluid material in the interior region of the container is pressurized the domed center portion will move automatically past an over center position to present a concave surface facing downwardly towards the interior region of the container while opening the slit(s) defining the normally closed discharge aperture to allow fluid material to flow under pressure from the interior region of the container into the discharge passageway formed in the closure.

In illustrative embodiments, the membrane is pre-formed to include a perimeter edge adapted to mate with the container and closure and a flat center portion. The flat center portion is formed to include the normally closed discharge aperture.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 3 is a partial sectional view of a package in accordance with a second embodiment of the present disclosure showing that the package includes the dispensing cap and container of FIGS. 1 and 2 and another embodiment of a flow control valve comprising a pliable membrane made of film and formed to include a normally closed discharge aperture as suggested in FIGS. 3A and 3B;

FIG. 3A is a perspective view of the flow control valve of FIG. 3 showing that the flow control valve is formed to include an aperture defined by a single slit;

FIG. 3B is a top plan view of the flow control valve of FIG. 3A;

Figure 9:
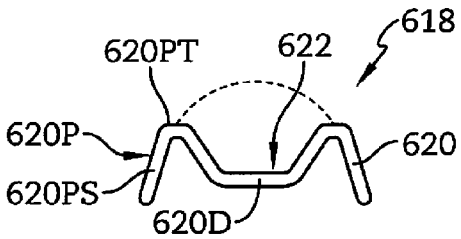
Figure 10:
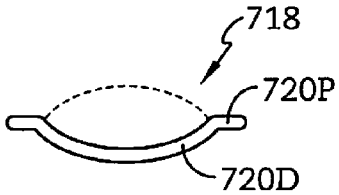
Figure 11:
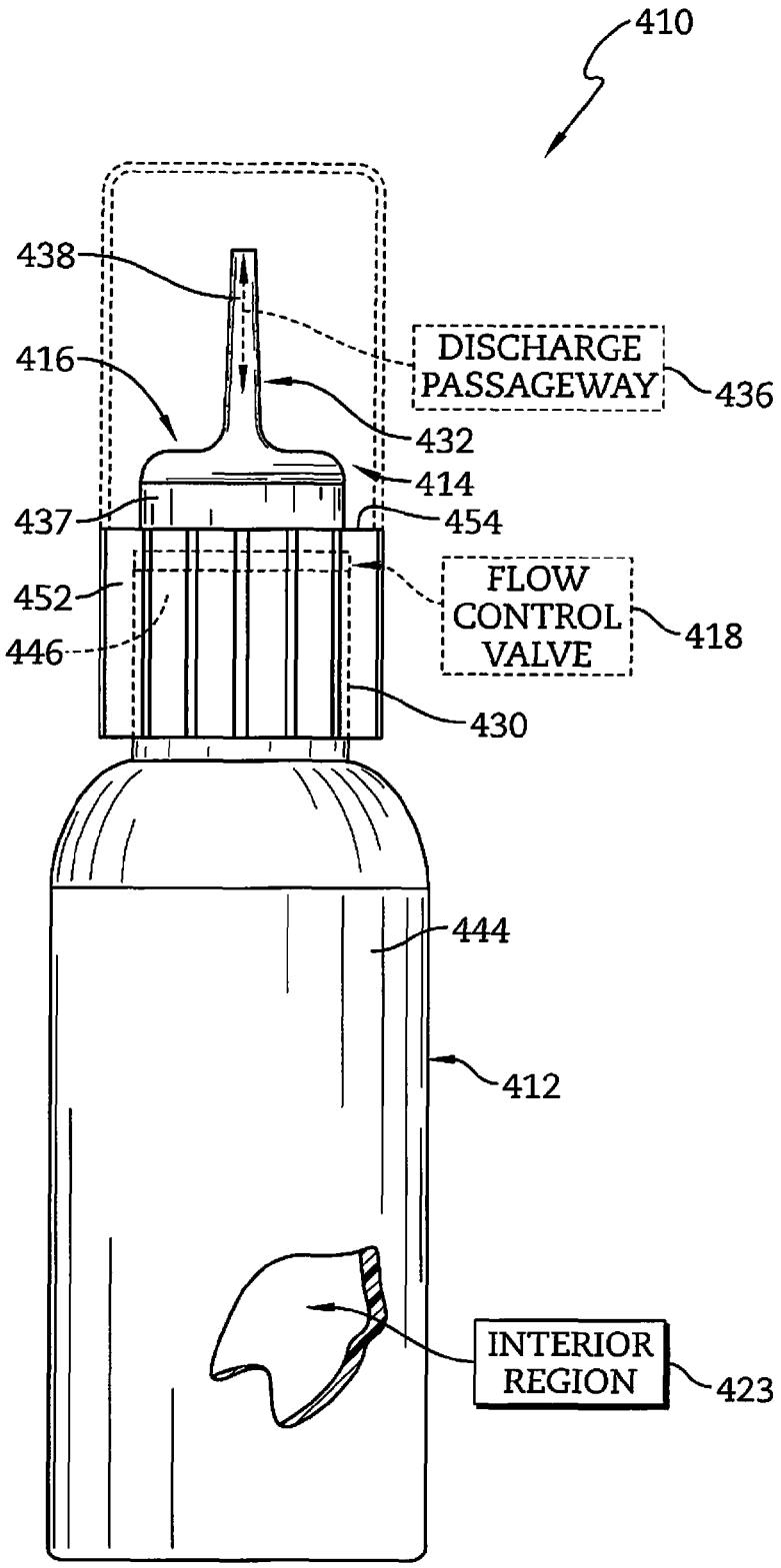
Figure 12:
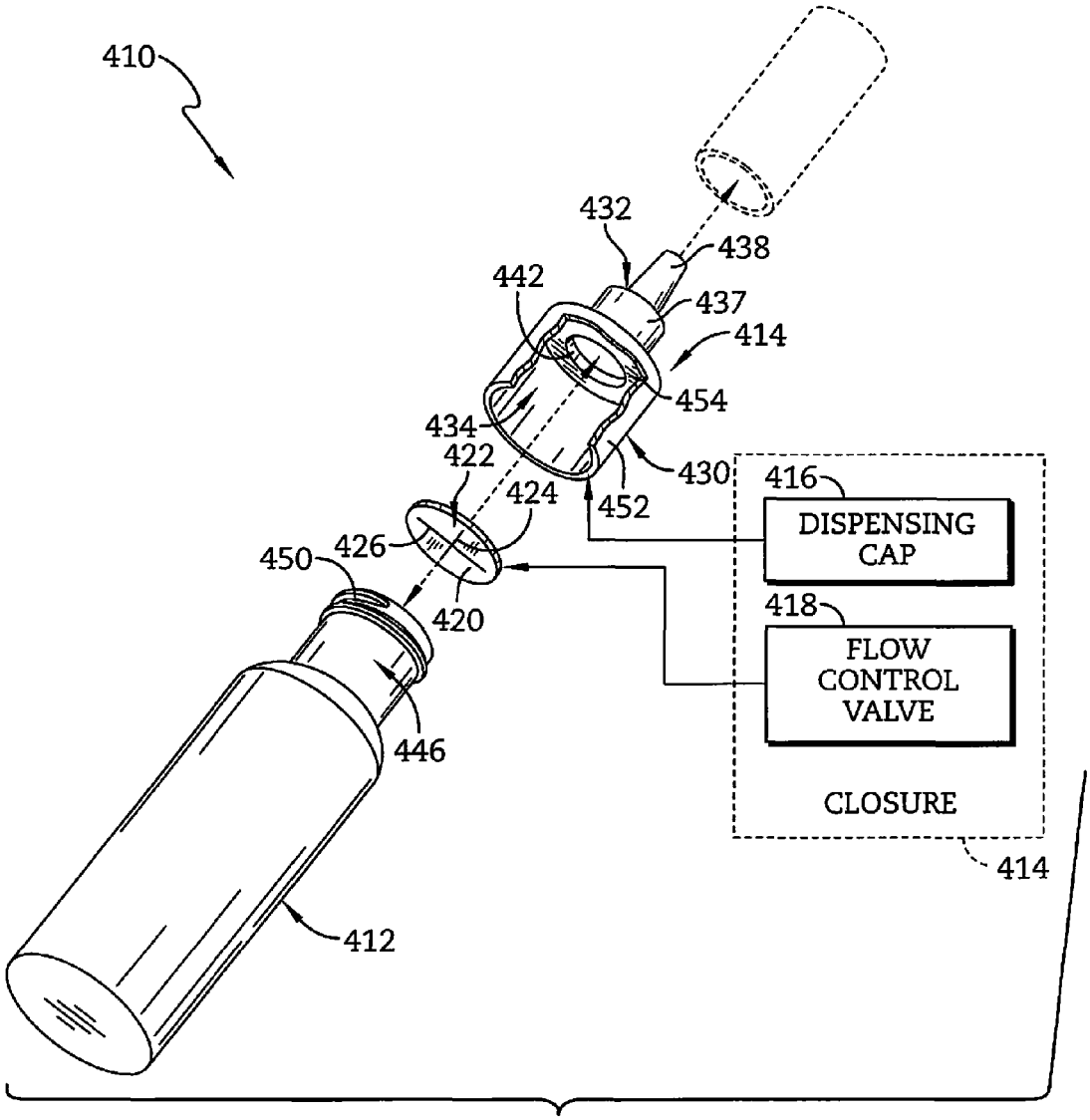
Figure 13:
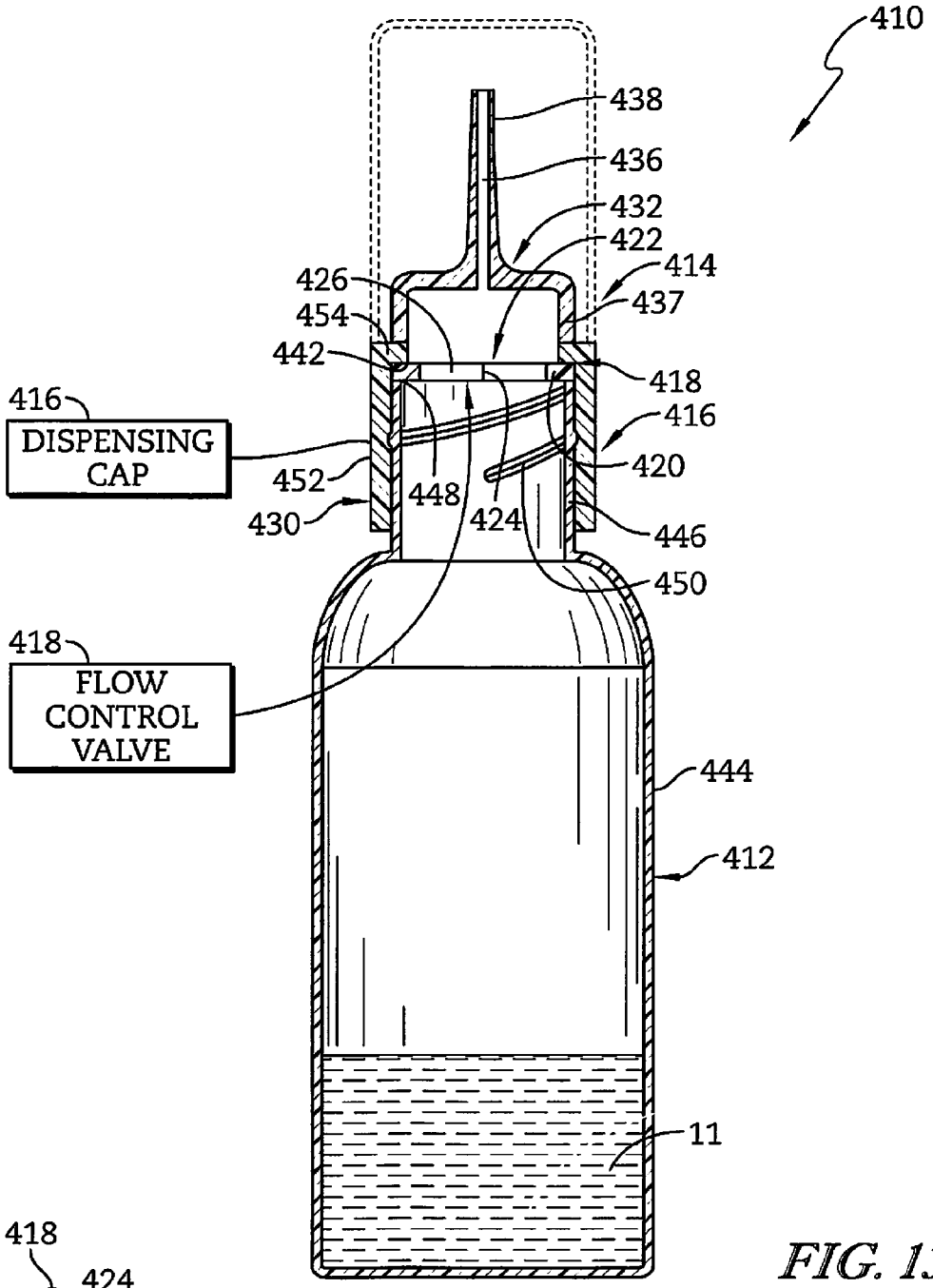
Figure 14:
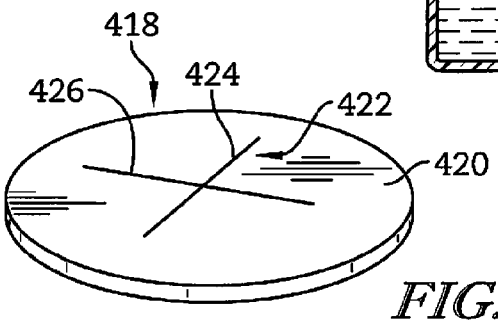
Figure 15:
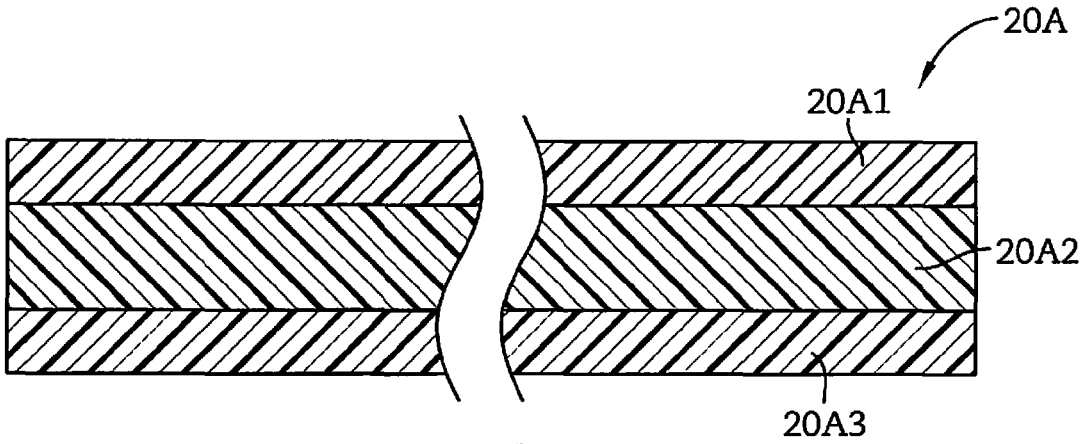
Figure 16:
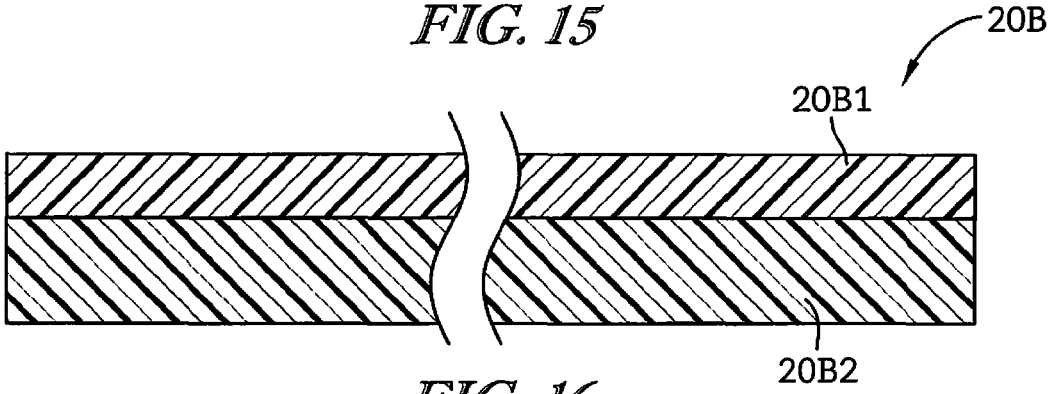
Figure 17:
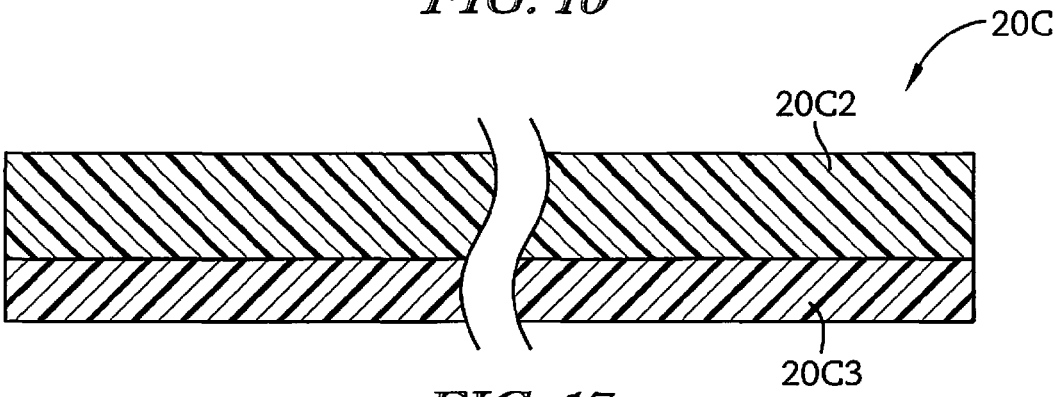
Figure 18:
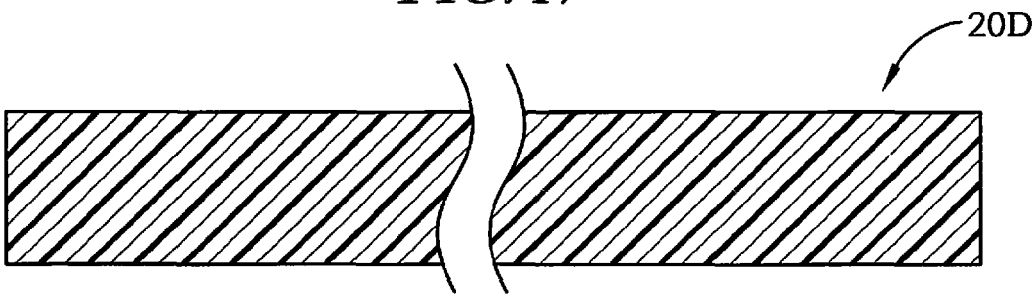
Figure 19:
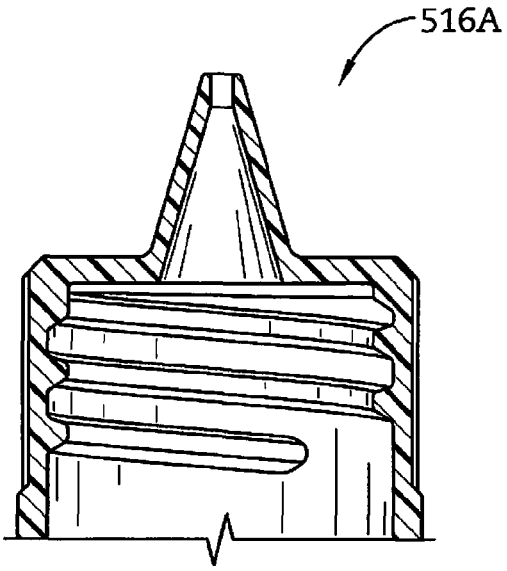
Figure 20:
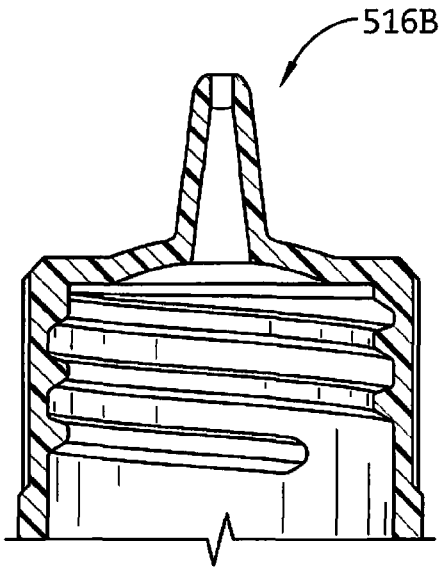
Figure 21:
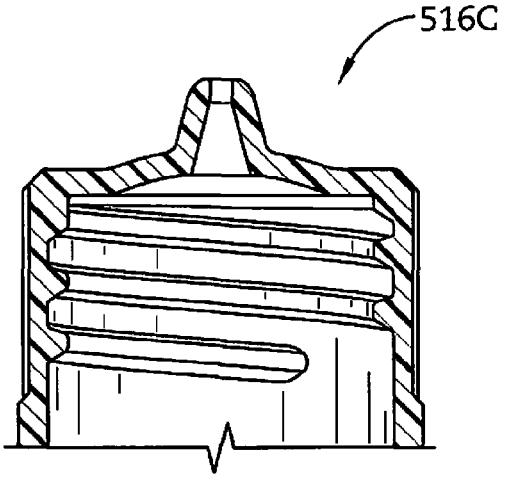
Figure 22:
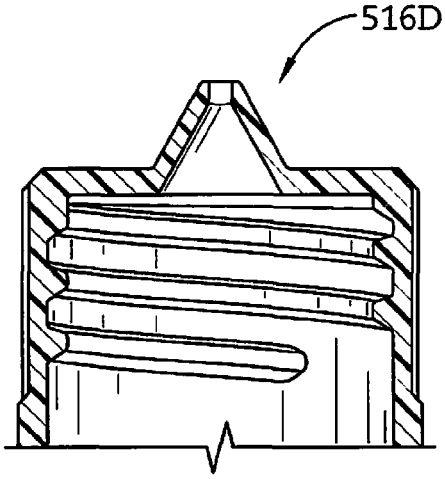
Figure 23:
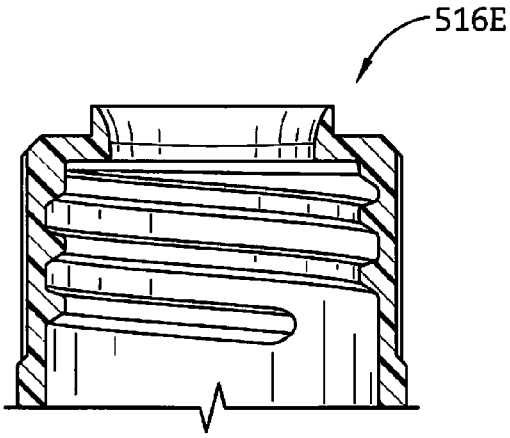
Figure 24:
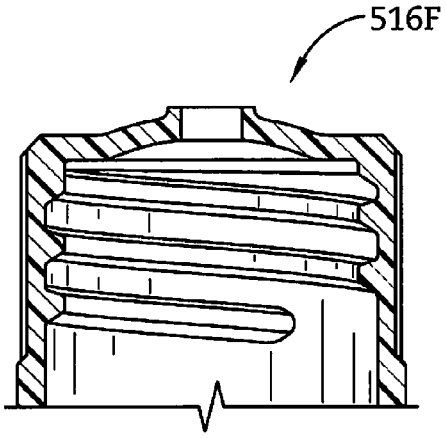
Figure 25:
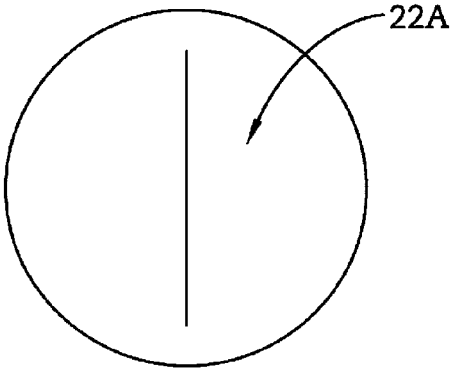
Figure 26:
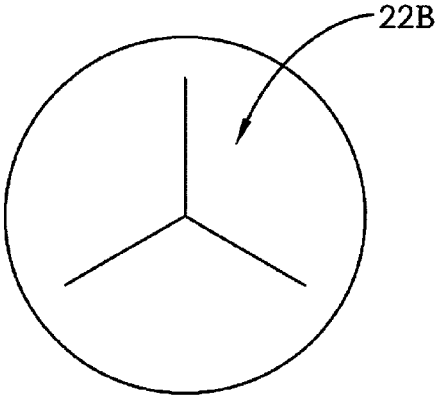
Figure 27A:
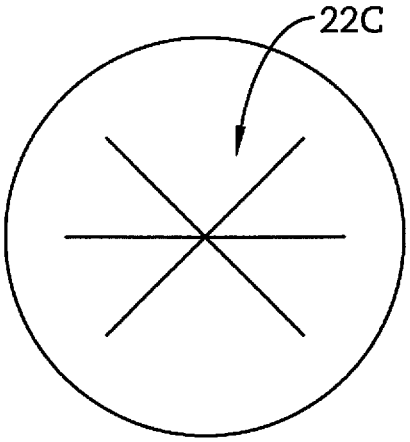
Figure 27B:
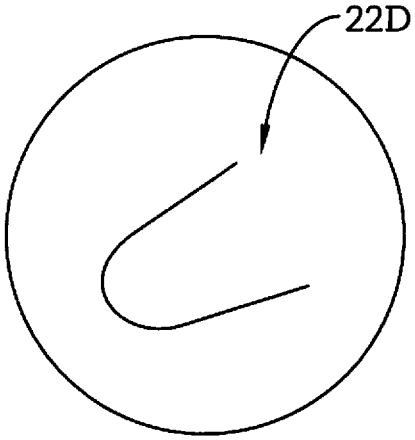
Figure 27C:
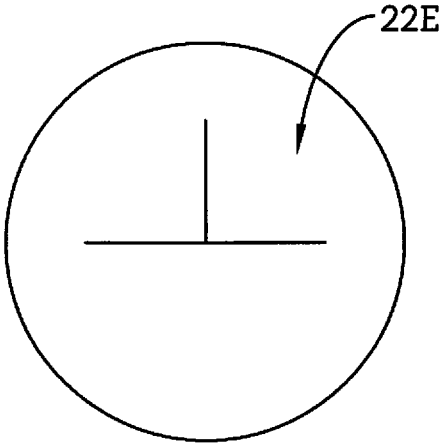
Figure 27D:
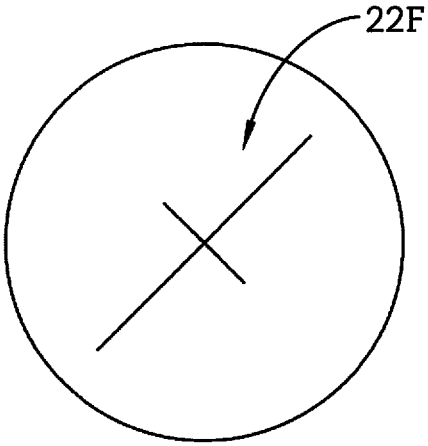
Figure 27E:
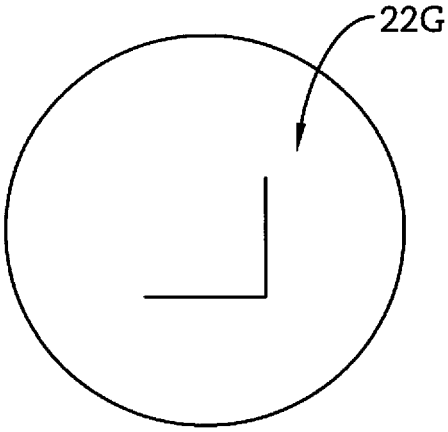
Figure 27F:
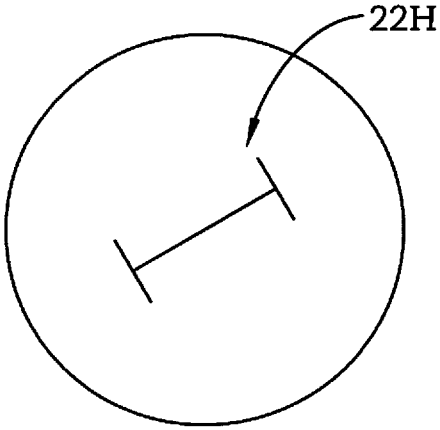
Figure 28:
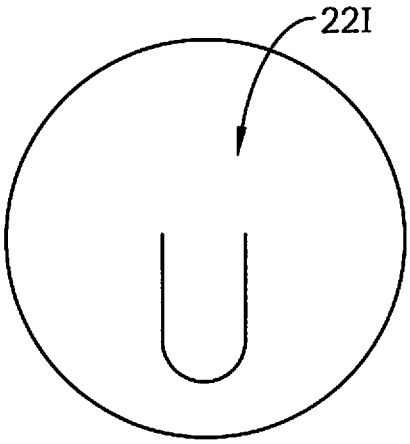
Figure 29:
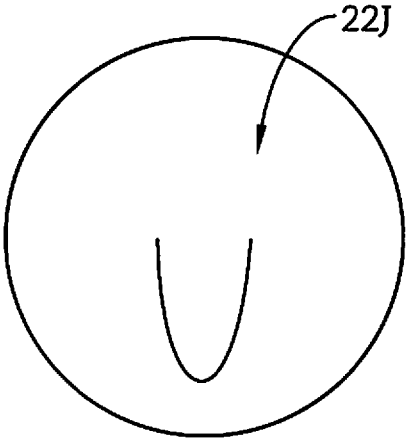
Figure 30:
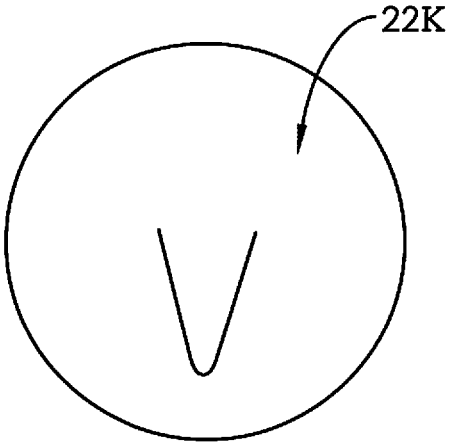
Figure 31:
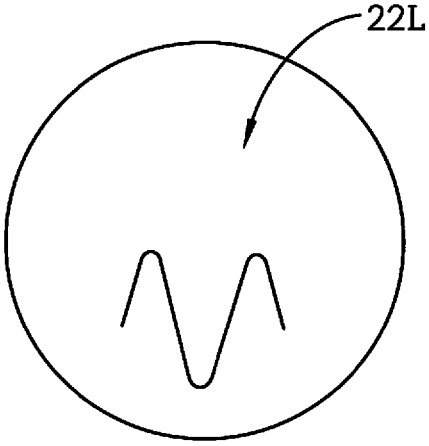
Figure 32:
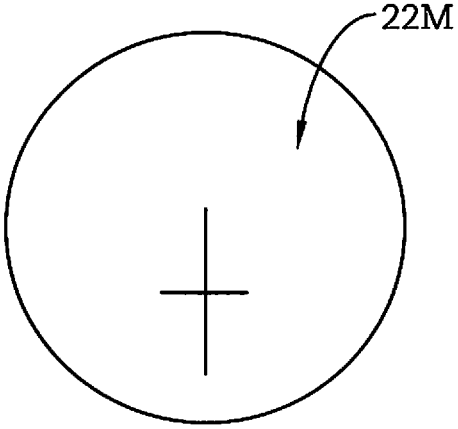
Figure 33:
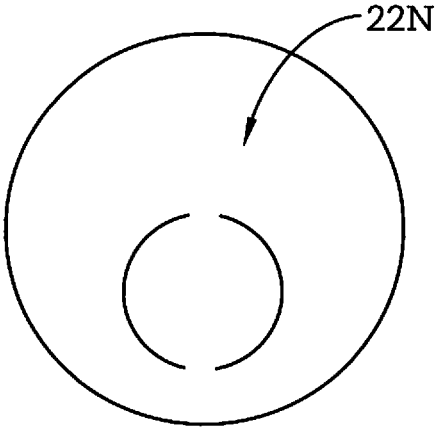
Figure 34:
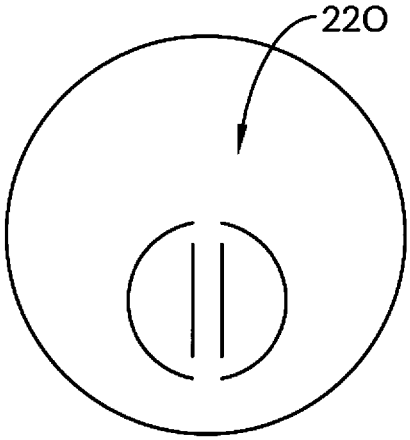
Figure 35:
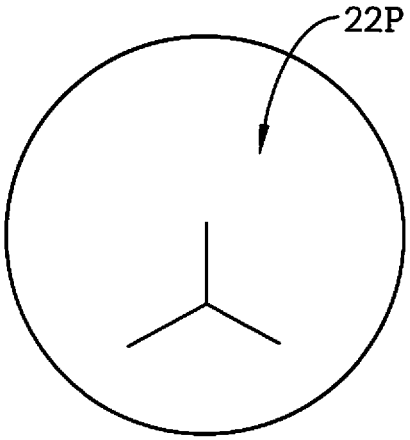
Figure 36:
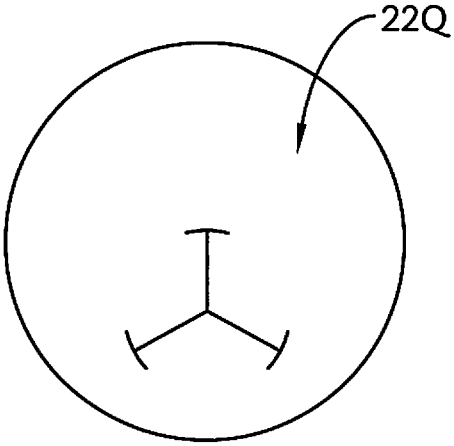
Figure 37:
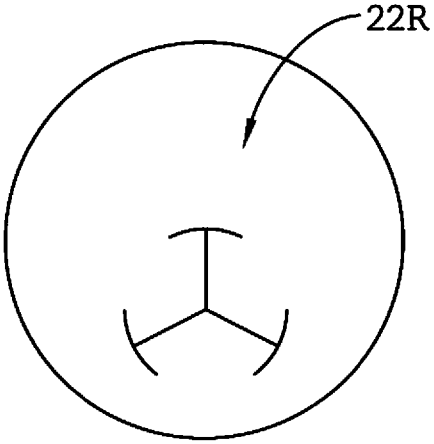
Figure 38:
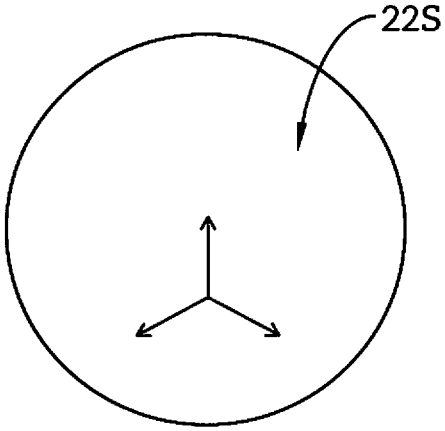
Figure 39:
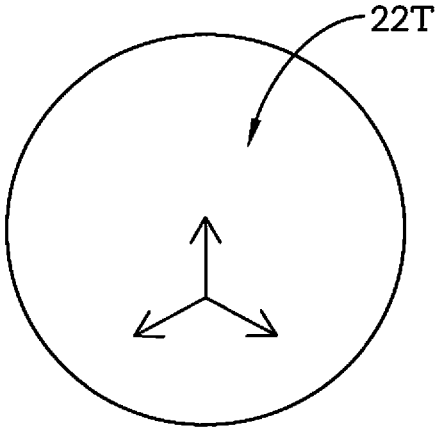
Figure 40:
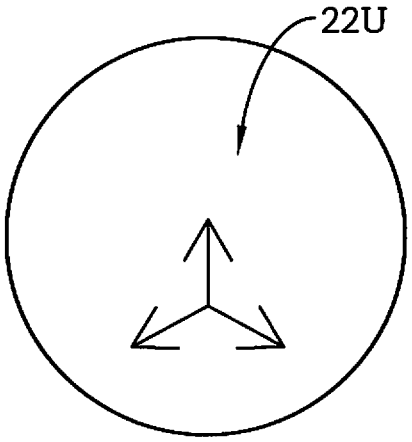
Figure 41:
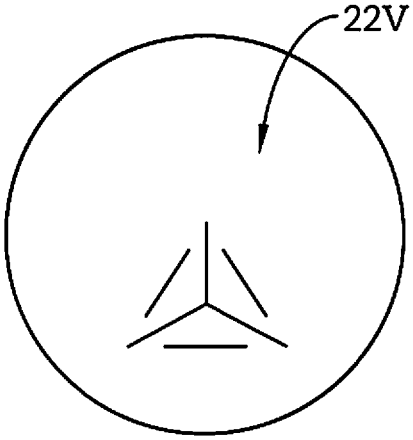
Figure 42:
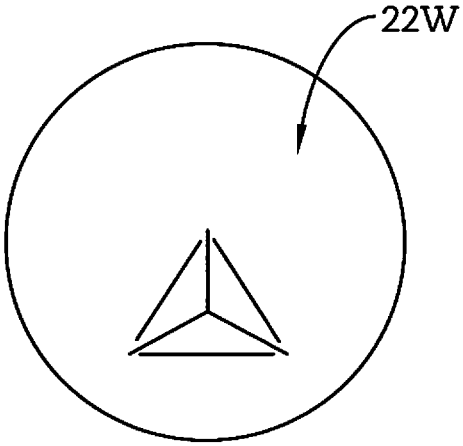
Figure 43:
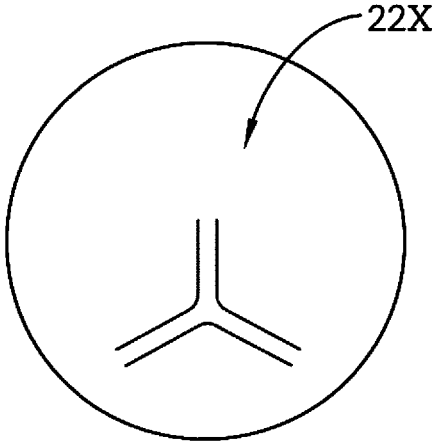
Figure 44:
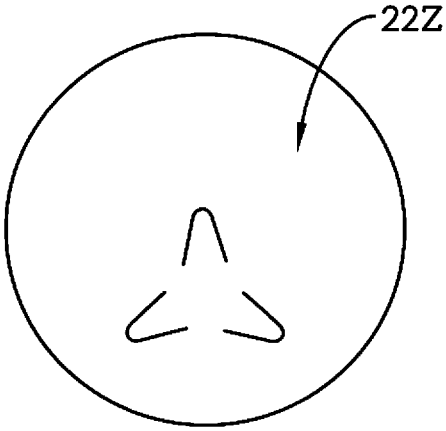
Figure 45:
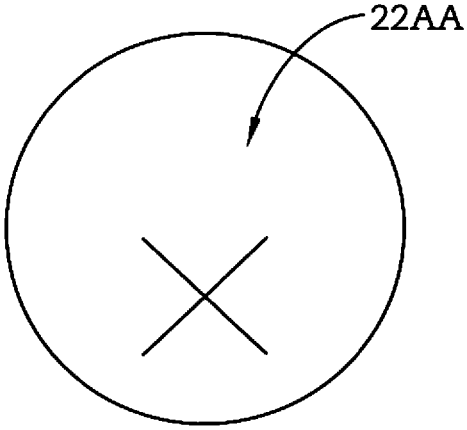
Figure 46:
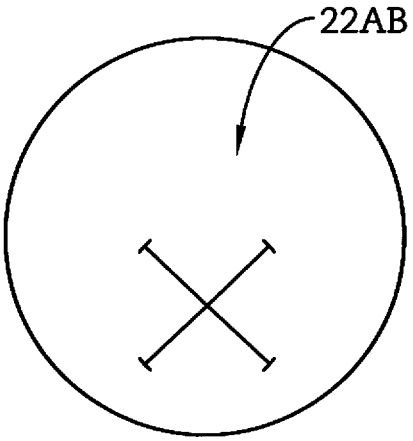
Figure 47:
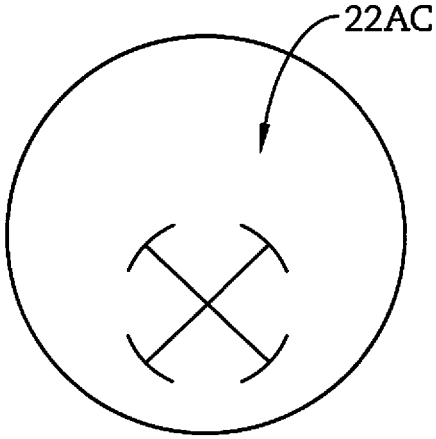
Figure 48:
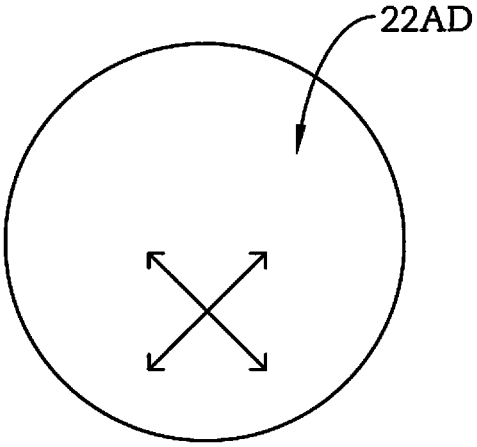
Figure 49:
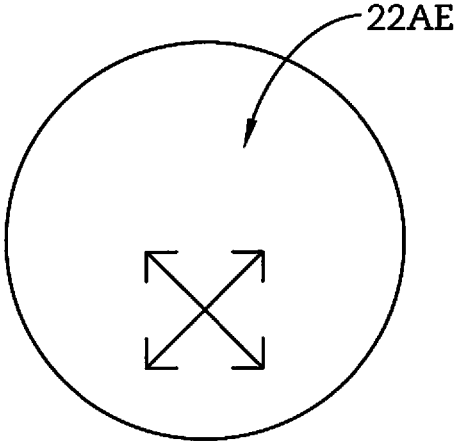
Figure 50:
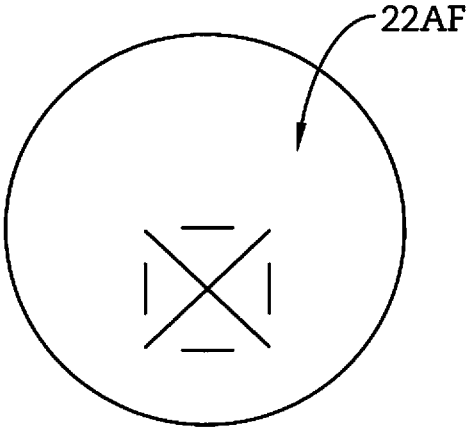
Figure 51:
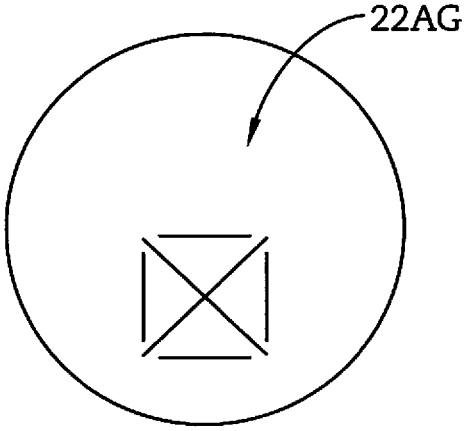
Figure 52:
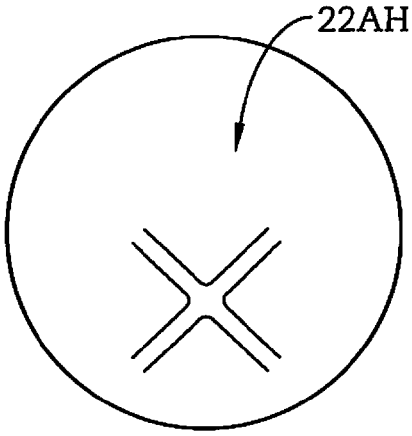
Figure 53:
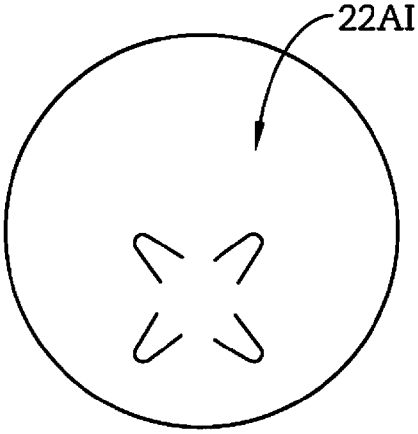
Figure 54:
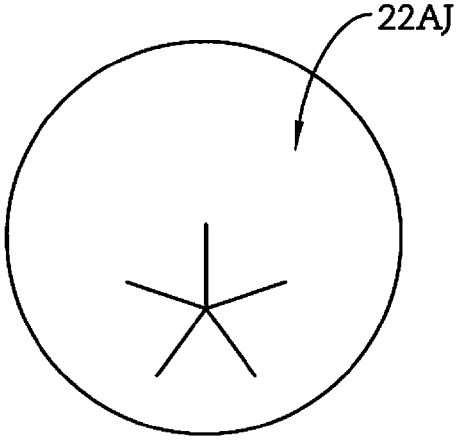
Figure 55:
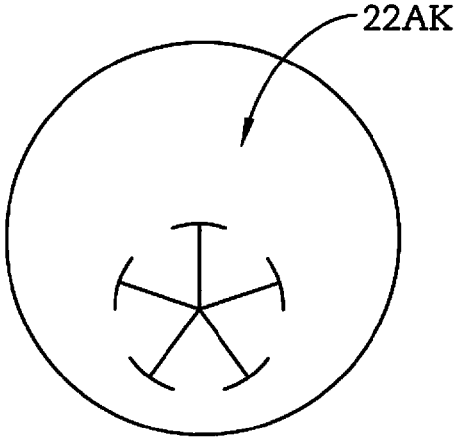
Figure 56:
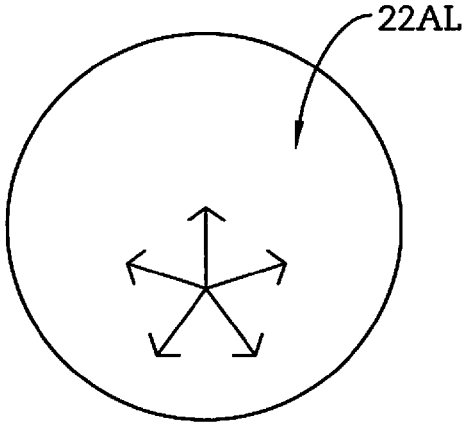
Figure 57:
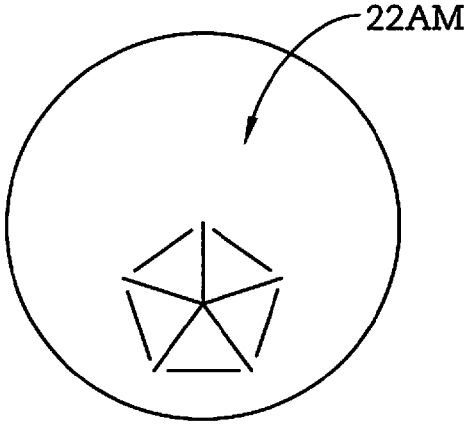
Figure 58:
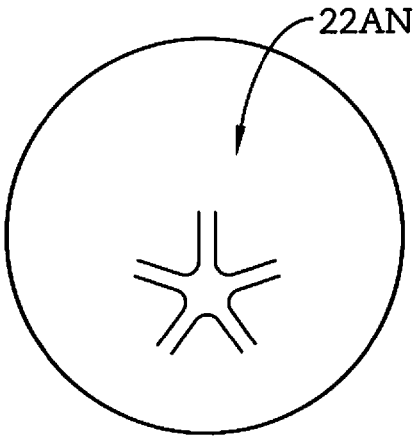
Figure 59:
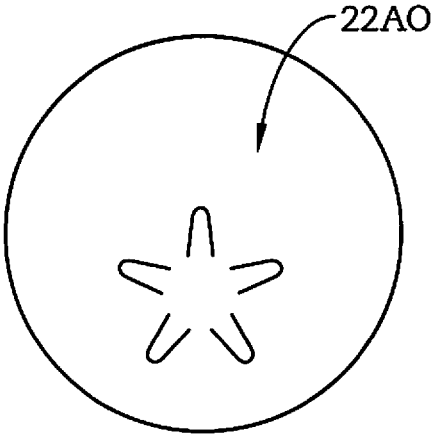
Figure 60:
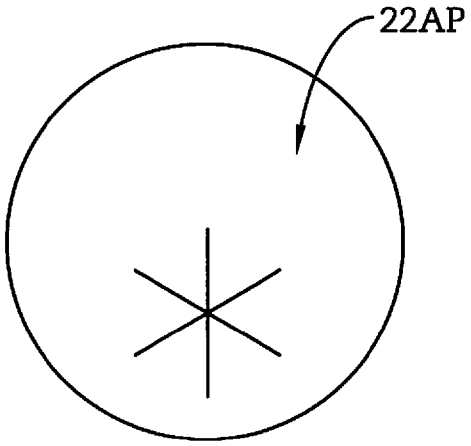
Figure 61:
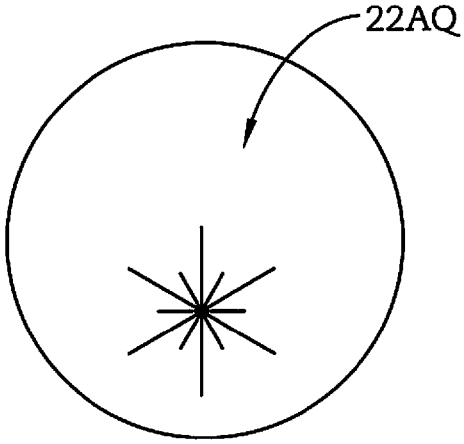
Figure 62:
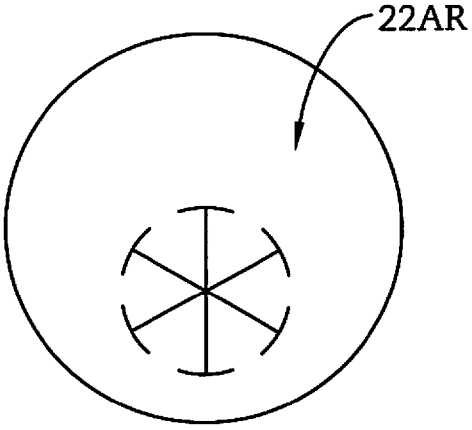
Figure 63:
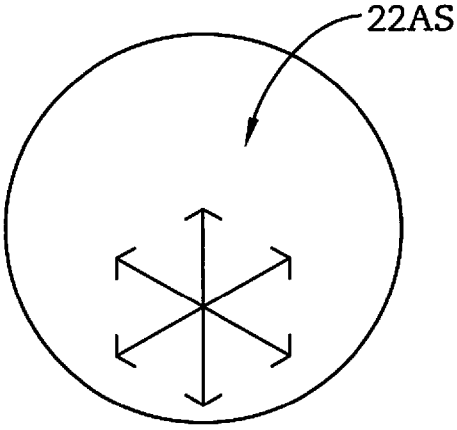
Figure 64:
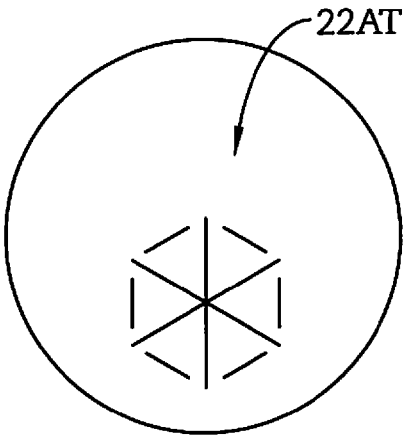
Figure 65:
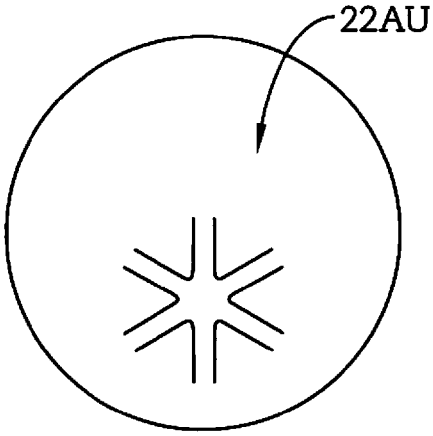
Figure 66:
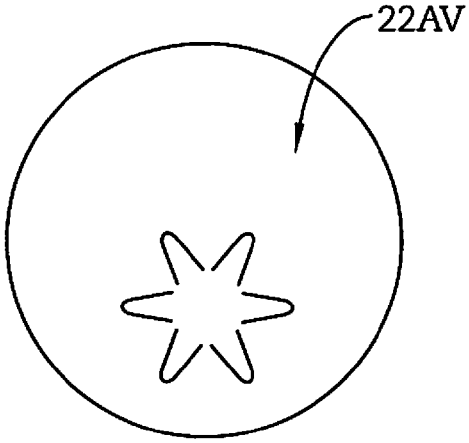
Figure 67:
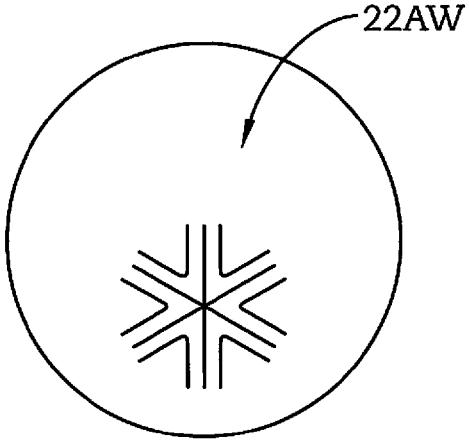
Figure 68:
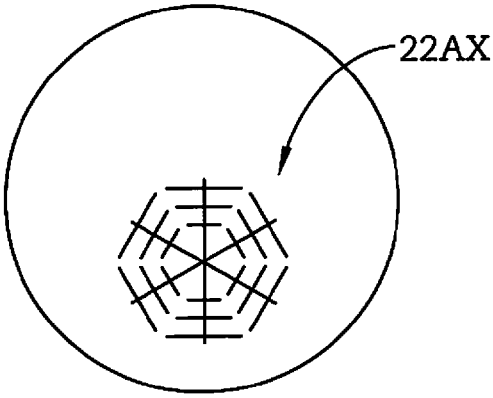

FIG. 9 is a diagrammatic view of a flow control valve in accordance with another embodiment of the present disclosure showing (in solid) that a membrane film is pre-formed to provide a domed center portion that is formed to include the normally closed discharge aperture and a convex surface arrangement to face in a downward direction to communicate with a pressurized fluid material stored in the interior region of the container and suggesting (in phantom) the new shape of the domed center portion after movement of the domed center portion upwardly past an over center position when exposed to underlying increased pressure extant in the interior region of the container;

FIG. 10 is a diagrammatic representations of another flow control valve in accordance with the present disclosure;

FIG. 11 is a side elevation view of a fifth embodiment of a package in accordance with the present disclosure suggesting that a flow control valve is interposed between and in fluid communication with an interior region formed in a container included in the package and a discharge passageway formed in a closure included in the package;

FIG. 12 is an exploded perspective assembly view of components included in the package of FIG. 11 showing, from bottom to top, a container, a flow control valve comprising a pliable membrane made of film and formed to include a normally closed discharge aperture defined by a pair of intersecting slits having substantially similar lengths, a dispensing cap, and an optional snap-on lid;

FIG. 13 is a partial sectional view of the package of FIG. 12;

FIG. 14 is a perspective view of the flow control valve of FIG. 12 showing that the flow control valve is formed to include an aperture defined by four slits of substantially similar length and arranged to extend away from a center point of the pliable membrane at about equal circumferential distances from one another;

FIG. 15 is a diagrammatic view of a first embodiment of a pliable membrane in accordance with the present disclosure showing that the pliable membrane includes an upper layer made of a first polymeric material, a core layer made of a second polymeric material, and a lower layer made of the first polymeric material;

FIG. 16 is a diagrammatic view of a second embodiment of a pliable membrane in accordance with the present disclosure showing that the pliable membrane includes an upper layer made of one polymeric material and a core layer made of a different polymeric material;

FIG. 17 is a diagrammatic view of a third embodiment of a pliable membrane in accordance with the present disclosure showing that the pliable membrane includes a core layer made of a one polymeric material and a lower layer made of a different polymeric material;

FIG. 18 is a diagrammatic view of a fourth embodiment of a pliable membrane in accordance with the present disclosure showing that the pliable membrane is a single layer made of a polymeric material;

FIG. 19 is a sectional view of another embodiment of a dispensing cap in accordance with the present disclosure;

FIG. 20 is a sectional view of another embodiment of a dispensing cap in accordance with the present disclosure;

FIG. 21 is a sectional view of another embodiment of a dispensing cap in accordance with the present disclosure;

FIG. 22 is a sectional view of another embodiment of a dispensing cap in accordance with the present disclosure;

FIG. 23 is a sectional view of another embodiment of a dispensing cap in accordance with the present disclosure;

FIG. 24 is a sectional view of another embodiment of a dispensing cap in accordance with the present disclosure;

FIG. 25 is a plan view of another embodiment of a flow control valve in accordance with the present disclosure;

FIG. 26 is a plan view of another embodiment of a flow control valve in accordance with the present disclosure;

FIGS. 27A-27F are a series of plan views showing differently shaped normally closed discharge apertures for use in flow control valves in accordance with the present disclosure; and FIGS. 28-68 are a series of plan views showing differently shaped normally closed discharge apertures for use in flow control valves in accordance with the present disclosure.

DETAILED DESCRIPTION

Figure 1:
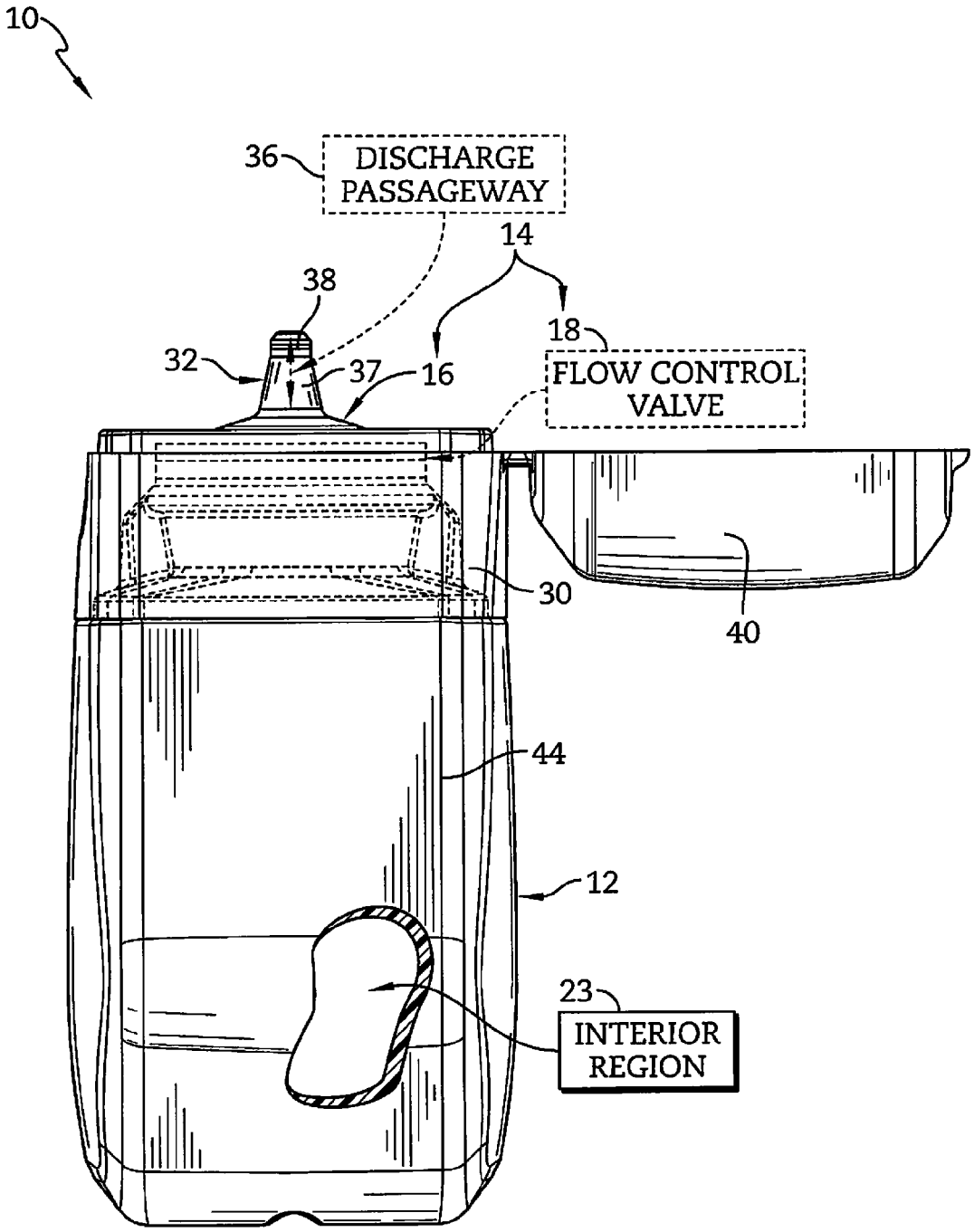
FIG. 1 is a side elevation view of a first embodiment of a package in accordance with the present disclosure suggesting that a flow control valve is interposed between and in fluid communication with an interior region formed in a container included in the package and a discharge passageway formed in a closure included in the package.
Figure 2A:
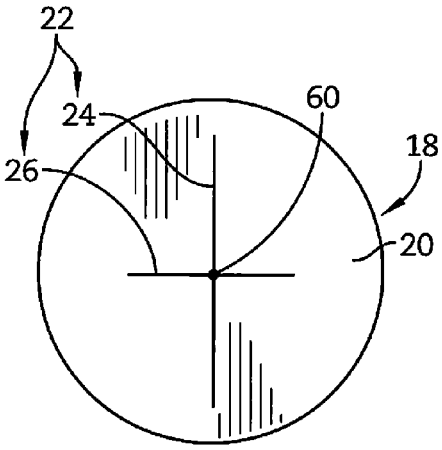
FIG. 2A is a plan view of the flow control valve of FIG. 2.
Figure 2:
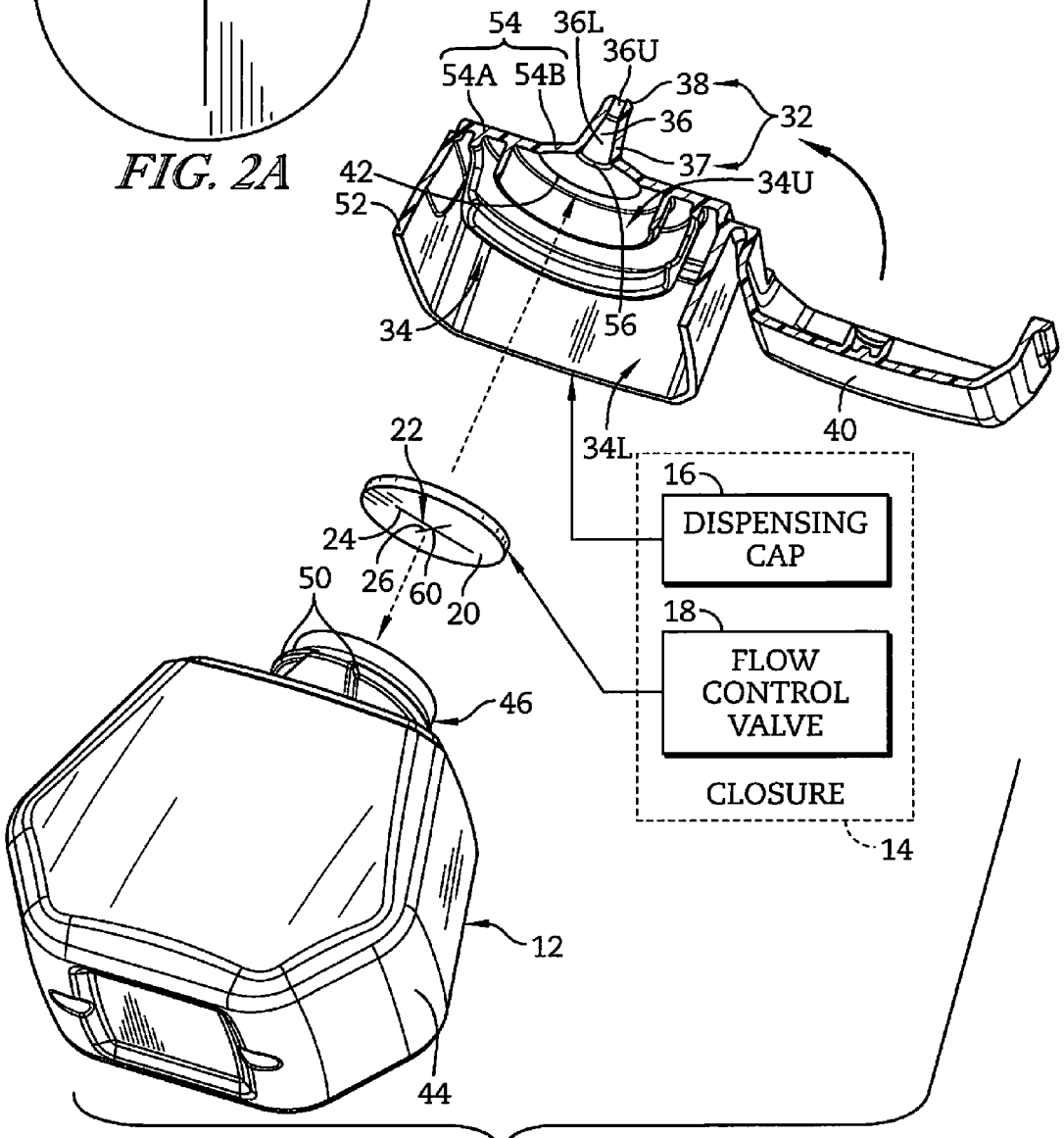
FIG. 2 is an exploded perspective assembly view of components included in the package of FIG. 1 showing, from bottom to top, a container, a flow control valve comprising a pliable membrane made of film and formed to include a normally closed discharge aperture defined by a pair of intersecting slits having different lengths, a dispensing cap, and an optional flip-top lid.
Figure 4:
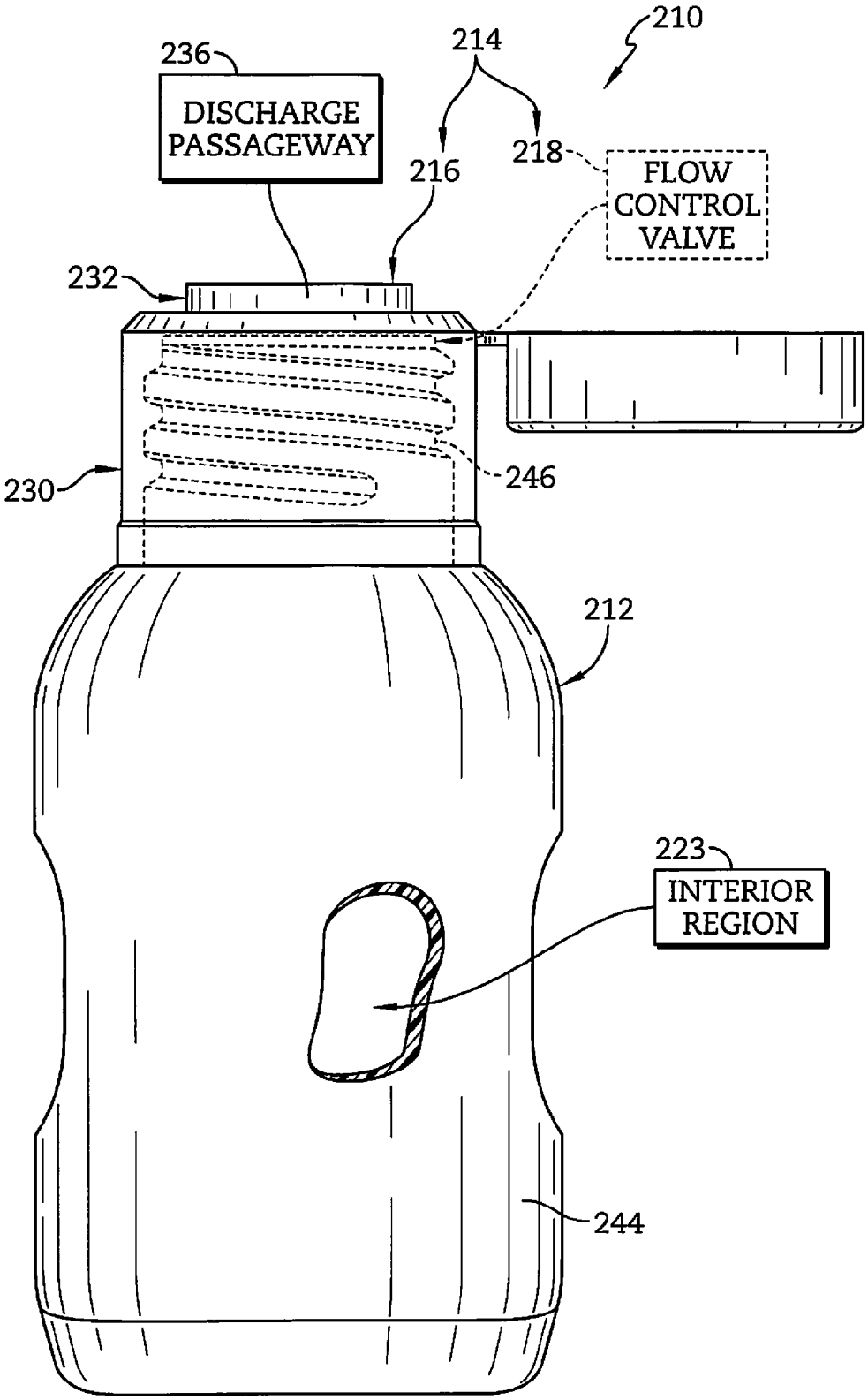
FIG. 4 is a side elevation view of a third embodiment of a package in accordance with the present disclosure suggesting that a flow control valve is interposed between and in fluid communication with an interior region formed in a container included in the package and a discharge passageway formed in a closure included in the package.
Figures 5, 5A:
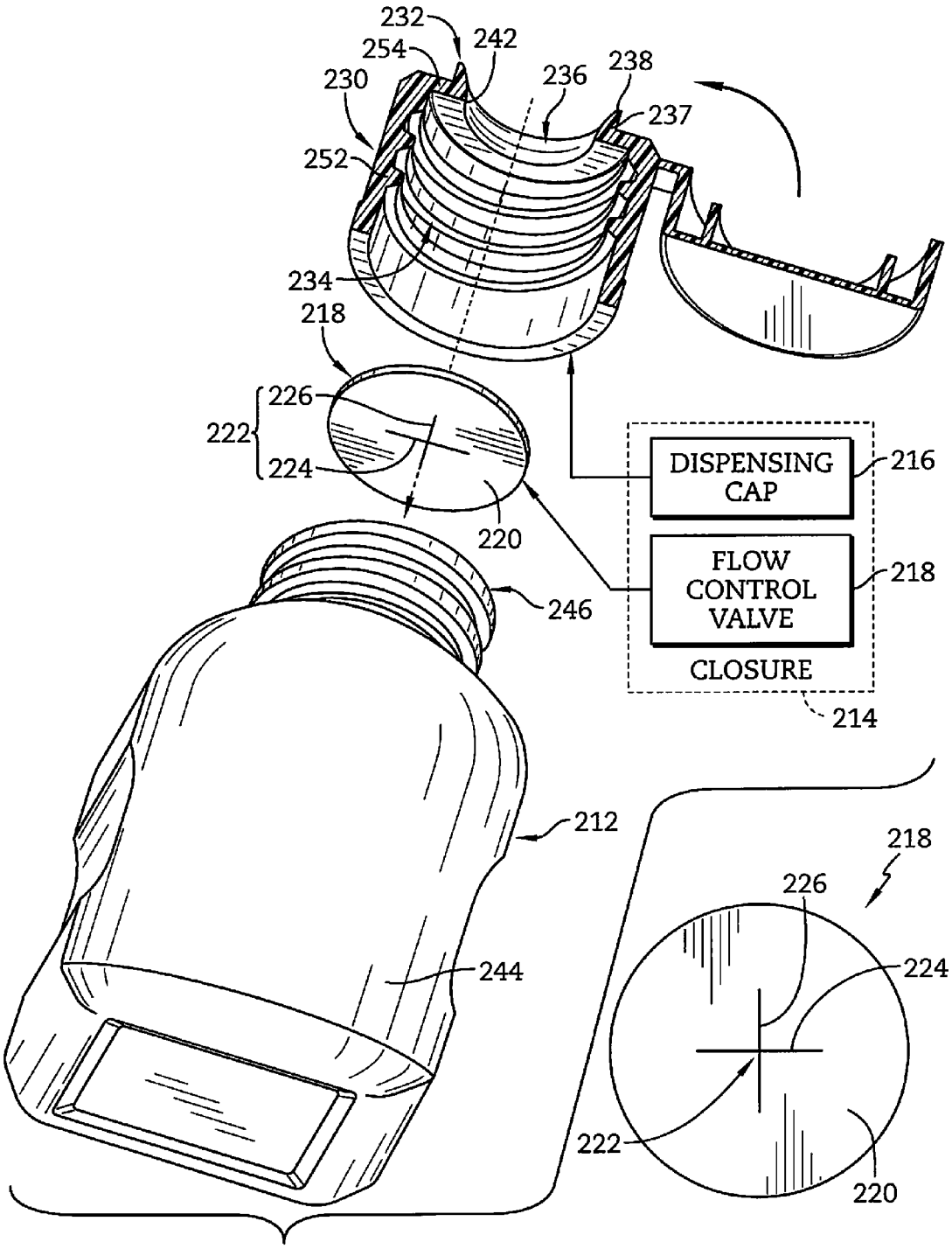
FIG. 5 is an exploded perspective assembly view of components included in the package of FIG. 4 showing, from bottom to top, a container, a flow control valve comprising a pliable membrane made of film and formed to include a normally closed discharge aperture defined by a pair of intersecting slits having substantially similar lengths, a dispensing cap, and an optional flip-top lid.
FIG. 5A is top plan view of the flow control valve of FIG. 5.
Figure 7:
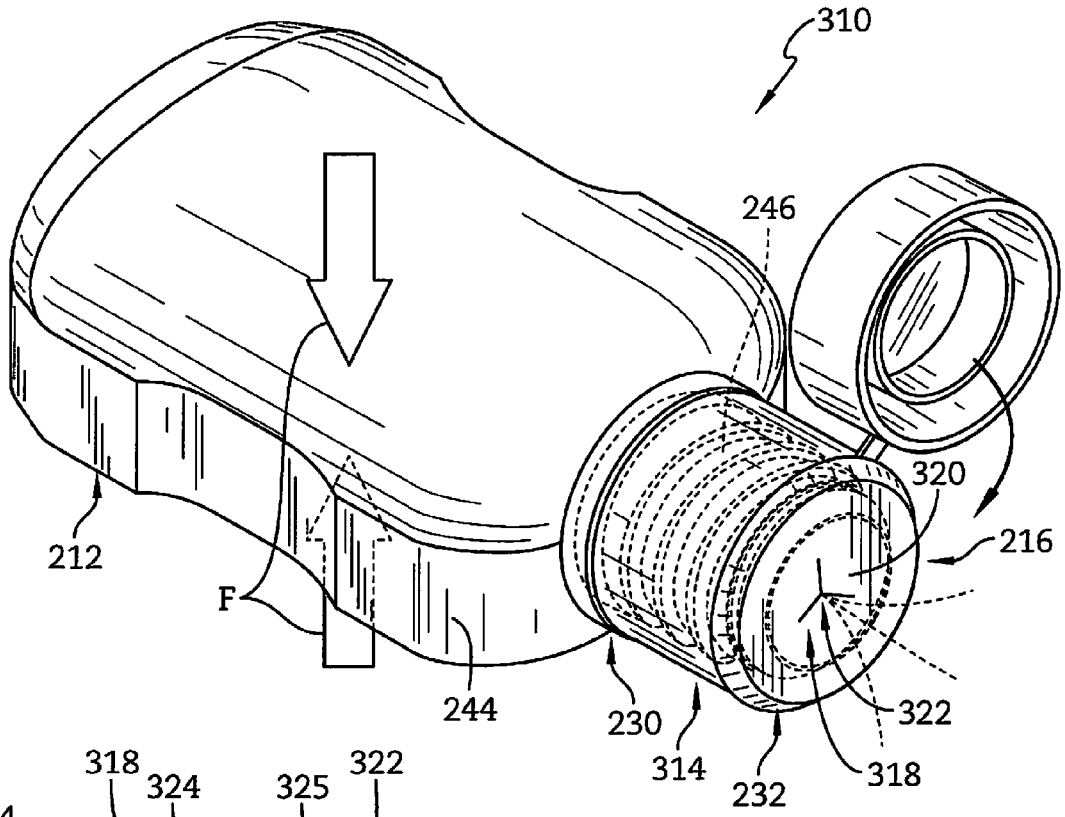
FIG. 7 is a perspective view of the package of FIG. 6 showing discharge of fluid through an opened discharge aperture formed in the flow control valve and through the product-discharge spout formed in the dispensing cap in response to increased pressure in the interior region of the container caused by squeezing (double arrow) the container.
Figure 8:
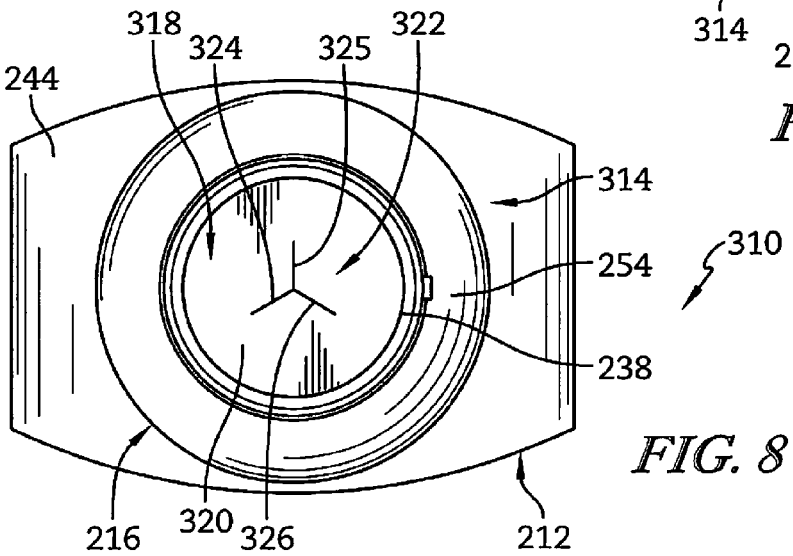
FIG. 8 is top plan view of the container of FIG. 7 with the flip-top lid removed.

A first embodiment of a package 10 in accordance with the present disclosure is shown in FIGS. 1 and 2. A second embodiment of a package 110 in accordance with the present disclosure is shown in FIG. 3. A third embodiment of a package 210 in accordance with the present disclosure is shown in FIGS. 4 and 5. A fourth embodiment of a package 310 in accordance with the present disclosure is shown in FIGS. 7 and 8. A fifth embodiment of a package 410 in accordance with the present disclosure is shown in FIGS. 11, 12, and 13. Each package includes a container, a flow control valve, and a dispensing cap. The flow control valve is made from a film and various embodiments of films in accordance with the present disclosure are shown in FIGS. 15-18. Various embodiments of dispensing caps in accordance with the present disclosure are shown in FIGS. 19-24. Various shapes of apertures 22A-22AX formed in the flow control valves in accordance with the present disclosure are shown in FIGS. 25-68.

A package 10 includes a container 12, and a closure 14 comprising a dispensing cap 16 and a flow control valve 18 is suggested in FIGS. 1-2. Flow control valve 18 is a pliable membrane 20 made of film and formed to include a normally closed discharge aperture 22 defined by a pair of intersecting slits 24, 26 as suggested in FIGS. 2 and 2A. Normally closed discharge aperture 22 formed in pliable membrane 20 is configured to provide means for regulating flow of fluid material 11 from the interior region 23 of container 12 into a discharge passageway 36 formed closure 14 through normally closed discharge aperture 22 in the event container 12 is squeezed to pressurize fluid material 11 stored in interior region 23 of container 12.

In one example, first and second slits 24, 26 are arranged to extend through a center point 60 of pliable membrane 20 as suggested in FIGS. 2 and 2A. As shown in FIG. 2A, first slit 24 has a length and second slit 26 has a relatively smaller length.

Container 12 includes a container body 44 and a filler neck 46 coupled to container body 44 in an illustrative embodiment shown in FIG. 2. Container body 44 and filler neck 46 cooperate to form an interior region 23 of container 12. A mouth 48 formed in filler neck 46 opens into interior region 23. Cap retainers 50 or other suitable closure retainers such as threads, are coupled to filler neck 46 and configured to mate with closure 14 to retain closure 14 in a mouth-closing position on filler neck 46 as suggested in FIGS. 1 and 2. It is within the scope of the present disclosure to mount pliable membrane 20 of flow control valve 18 in a stationary position on filler neck 46 to cause the normally closed discharge aperture 22 formed in pliable membrane 20 to communicate with interior region 23 formed in container 12.

Dispensing cap 16 includes a cap body 30 adapted to be coupled to filler neck 46 and a product-discharge spout 32 coupled to cap body 30 as suggested in FIGS. 1 and 2. Cap body 30 is formed to include a neck-receiving cavity 34 sized to receive a portion of filler neck 46 therein when closure 14 is mounted on filler neck 46. Product-discharge spout 32 is formed to include discharge passageway 36 as shown suggested in FIGS. 1, 2, and 3. In an illustrative embodiment, pliable membrane 20 is located in neck-receiving cavity 34 and coupled to cap body 30 to move therewith relative to filler neck 46. For example, when cap body 30 is separated from filler neck 46, pliable membrane 20 is retained with cap body 30.

Cap body 30 of dispensing cap 16 includes an annular side wall 52 arranged to surround filler neck 46 when closure 14 is mounted on filler neck 46 and a top wall 54 coupled to an outer end of annular side wall 52 as shown, for example, in FIG. 2. Side and top walls 52, 54 cooperate to form a boundary of neck-receiving cavity 34. Top wall 54 is formed to include an interior edge 56 bordering an opening into the discharge passageway 36 formed in product-discharge spout 32 as suggested in FIGS. 2 and 3. Top wall 54 also includes outer portion 54A arranged to surround interior edge 42 and mate with pliable membrane 20 of flow control valve 18 to place the normally closed discharge aperture 22 in fluid communication with neck-receiving cavity 34 of cap body 30 and discharge passageway 36 of product-discharge spout 32.

Top wall 54 of cap body 30 includes a flat outer portion 54A coupled to side wall 52 and a convex portion 54B arranged to extend between and interconnect flat outer portion 54A and product-discharge spout 32 as shown in FIG. 3. Flat outer portion 54A is arranged to extend from side wall 52 toward convex portion 54B. Convex portion 54B is arranged to extend upwardly away from container 12 and interconnect flat outer portion 54A and product-discharge spout 32. As a result, product-discharge spout 32 is located in axially spaced-apart relation above flat outer portion 54A of top wall 54.

Product-discharge spout 32 of dispensing cap 16 includes a base 37 and a tip 38 as suggested in FIGS. 2 and 3. Base 37 is coupled to an upper part of cap body 30 and tip 38 is coupled to an upper part of base 37. Discharge passageway 36 includes an upper section 36U and a lower section 36L both formed in tip 38 as shown, for example, in FIG. 3. As suggested in FIG. 3, cap body 30 has a diameter and product-discharge spout 32 has a length. In one example, a ratio of diameter to length is less than about 5. In another example, the ratio is less than about 4. In another example, the ratio is less than about 3. In still yet another example, the ratio is about 2. The ratio provides an indicator of whether the product-discharge spout is relatively short or relatively long as shown in FIG. 3.

During use, flow control valve 18 moves between the normally closed position and a pressurized open position in which pressurized fluid material 11 is permitted to be communicated from interior product-storage region 23, through normally closed discharge aperture 22 and into discharge passageway 36. When flow control valve 18 is in the pressurized open position, a portion of flow control valve 18 is arranged to extend toward discharge passageway 36.

Neck-receiving cavity 34 includes an upper portion 34U and a lower portion 34L as shown in FIG. 3. Upper portion 34U is defined in part by flow control valve 18 when flow control valve 18 is in the normally closed position and in part by convex portion 54B. Lower portion 34L is defined in part by flat outer portion 54A and side wall 52 as shown in FIG. 3. Flow control valve 18 is located in lower portion 34L of neck-receiving cavity 34 when flow control valve 18 is in the normally closed position. A portion of flow control valve 18 extends out of lower portion 34L into upper portion 34U when flow control valve 18 is in the pressurized open position.

A flip-top lid 40 is included in package 10 in an illustrative embodiment as shown, in FIGS. 1-3. Lid 40 is configured to cover product-discharge spout 32 and mate with cap body 30. Lid 40 is made of a transparent material in an illustrative embodiment.

In use, fluid material 11 flows from interior region 23, through normally closed discharge aperture 22, through discharge passageway 36, and into environment surrounding package 10 when container 12 is squeezed by a user. In one example, squeezing container 12 applies pressure directly to fluid material 11 to cause normally closed discharge aperture to open so that fluid material 11 is expelled there through. In another example, squeezing container 12 pressurizes gas in interior region 23 which then works on fluid material 11 to cause normally closed discharge aperture to open so that fluid material 11 is expelled there through.

A pliable membrane or film in accordance with the present disclosure may include one layer, two layers, three layers, or other suitable number of layers. A first embodiment of a film 20A includes three layers and is shown in FIG. 15. A second embodiment of a film 20B includes two layers and is shown in FIG. 16. A third embodiment of a film 20C includes two layers and is shown in FIG. 17. A fourth embodiment of a film 20D includes one layer and is shown in FIG. 18.

In on illustrative example, pliable membrane 20 is made from a film as suggested in FIGS. 15-17. In another example, pliable membrane 20 is made via an extrusion process, a co-extrusion process, a co-injection process, an injection process, a compression molding process, or any other suitable processes.

Film 20A includes an upper layer 20A1, a core layer 20A2, and a lower layer 20A3. Upper layer 20A1 is located in spaced-apart relation to container 12 and configured to engage dispensing cap 16. Lower layer 20A3 is located in spaced-apart relation to upper layer 20A1 and configured to engage filler neck 46. Core layer 20A2 is located between upper layer 20A1 and lower layer 20A3 as shown in FIG. 15. In one example, film 20A has an overall thickness of about 6 mil to about 7 mil.

In one example, upper layer 20A1 includes a polypropylene material. In another example, upper layer 20A1 is a polypropylene material. Upper layer 20A1 has a thickness of about 1 mil, for example.

In one example, lower layer 20A3 includes a polypropylene material. In another example, lower layer 20A3 is a polypropylene material. Lower layer 20A3 has a thickness of about 1 mil, for example.

In one example, core layer 20A2 includes a polyester material. In another example, core layer 20A2 is a polyester material. Core layer 20A2 has a thickness of about 4 mil to about 5 mil.

Film 20B includes an upper layer 20B1 and a core layer 20B2 as shown in FIG. 16. Upper layer 20B1 is located in spaced-apart relation to container 12 and configured to engage dispensing cap 16. Core layer 20B2 engages both upper layer 20B1 and filler neck 46. Core layer 20B2 is located between upper layer 20B1 and filler neck 46. In one example, film 20B has an overall thickness of about 5 mil to about 6 mil.

In one example, upper layer 20B1 includes a polypropylene material. In another example, upper layer 20B1 is a polypropylene material. Upper layer 20B1 has a thickness of about 1 mil, for example.

In one example, core layer 20B2 includes a polyester material. In another example, core layer 20B2 is a polyester material. Core layer 20B2 has a thickness of about 4 mil to about 5 mil.

Film 20C includes a core layer 20C2 and a lower layer 20C3 as shown in FIG. 17. Core layer 20C2 is located in spaced-apart relation to filler neck 46 and arranged to engage dispensing cap 16. Lower layer 20C3 is located between filler neck 46 and core layer 20C2 and is configured to engage filler neck 46. In one example, film 20C has an overall thickness of about 5 mil to about 6 mil.

In one example, lower layer 20C3 includes a polypropylene material. In another example, lower layer 20C3 is a polypropylene material. Lower layer 20C3 has a thickness of about 1 mil, for example.

In one example, core layer 20C2 includes a polyester material. In another example, core layer 20C2 is a polyester material. Core layer 20C2 has a thickness of about 4 mil to about 5 mil.

As shown, for example, in FIG. 18, film 20D is a monolayer material. In one example, film 20D has a thickness of about 10 mil to about 15 mil. The monolayer material in one example includes a polyester material. In another example, the monolayer material is a polyester material. In another example, the monolayer material includes a polypropylene material. In another example, the monolayer material is a polypropylene material.

In one example, films 20A, 20B, 20C, 20D are substantially free of an elastomeric material, for example, silicone. In another example, films 20A, 20B, 20C, 20D may include minute amounts of an elastomeric material so long as the elastomeric material does not cause the film to have different material properties than films which are substantially free of the elastomeric material or affect the predominating material properties of the remainder of the film or so long as the.

A package 110 includes container 12, and a closure 114 comprising dispensing cap 16 and a flow control valve 118 is suggested in FIGS. 3-3B. Flow control valve 118 is a pliable membrane 120 made of film and formed to include a normally closed discharge aperture 122 defined by a single slit 124 as shown in FIGS. 3A and 3B. Normally closed discharge aperture 122 formed in pliable membrane 120 is configured to provide means for regulating flow of fluid material 11 from the interior region 23 of container 12 into discharge passageway 36 formed closure 114 through normally closed discharge aperture 122 in the event container 12 is squeezed to pressurize fluid material 11 stored in interior region 23 of container 12.

Single slit 124 formed in pliable membrane 120 is arranged to extend through a center point 60 of pliable membrane 120. In one example, single slit 124 has a length which is about 50% of a diameter of pliable membrane 120.

A package 210 includes a container 212, and a closure 214 comprising a dispensing cap 216 and a flow control valve 218 is suggested in FIGS. 4 and 5. Flow control valve 218 is a pliable membrane 220 made of film and formed to include a normally closed discharge aperture 222 defined by a pair of intersecting slits 224, 226 as suggested in FIGS. 5 and 5A. Normally closed discharge aperture 222 formed in pliable membrane 220 is configured to provide means for regulating flow of fluid material 11 from the interior region 223 of container 212 into a discharge passageway 236 formed closure 214 through normally closed discharge aperture 222 in the event container 212 is squeezed to pressurize fluid material 11 stored in interior region 223 of container 212.

In one example, first and second slits 224, 226 are arranged to extend through a center point 60 of pliable membrane 220 as suggested in FIGS. 5 and 5A. As shown in FIG. 5A, first slit 224 and second slit 226 have about the same length and arranged to establish a plus-sign shape.

Container 212 includes a container body 244 and a filler neck 246 coupled to container body 244 in an illustrative embodiment shown in FIG. 5. Container body 244 and filler neck 246 cooperate to form an interior region 223 of container 212. A mouth 248 formed in filler neck 246 opens into interior region 223. Threads 250, or other suitable closure retainers, are coupled to filler neck 246 and configured to mate with closure 214 to retain closure 214 in a mouth-closing position on filler neck 246 as suggested in FIGS. 4 and 5. It is within the scope of the present disclosure to mount pliable membrane 220 of flow control valve 218 in a stationary position on an end rim 226 of filler neck 246 to cause the normally closed discharge aperture 222 formed in pliable membrane 220 to communicate with interior region 223 formed in container 212.

Dispensing cap 216 includes a cap body 230 adapted to be coupled to filler neck 246 and a product-discharge spout 232 coupled to cap body 230 as suggested in FIGS. 4 and 5. Cap body 230 is formed to include a neck-receiving cavity 234 sized to receive a portion of filler neck 246 therein when closure 214 is mounted on filler neck 246. Product-discharge spout 232 is formed to include discharge passageway 236 as shown suggested in FIGS. 4, 5, and 6. In an illustrative embodiment, pliable membrane 220 is located in neck-receiving cavity 234 and coupled to cap body 230 to move therewith relative to filler neck 246. For example, when cap body 230 is separated from filler neck 246, pliable membrane 220 is retained with cap body 230.

Figure 6:
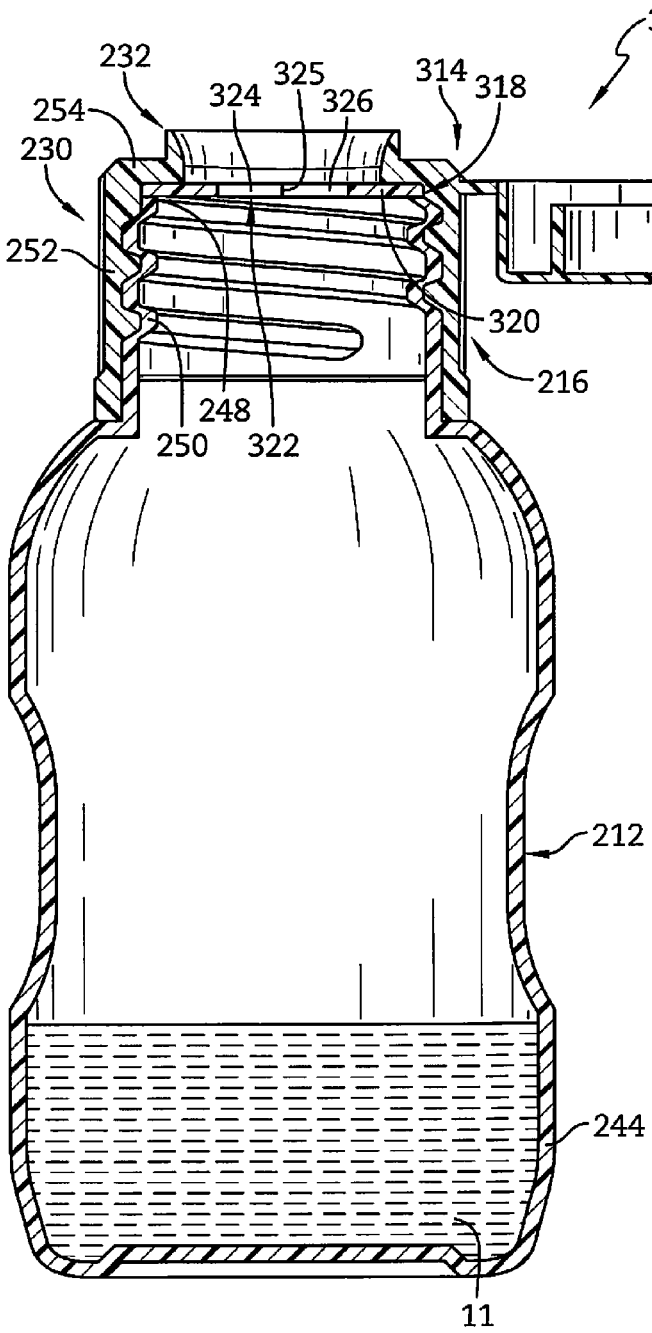
FIG. 6 is a partial sectional view of a package in accordance with a fourth embodiment of the present disclosure showing that the package includes the dispensing cap and container of FIGS. 4 and 5 and a another embodiment of a flow control valve comprising a pliable membrane made of film and formed to include a normally closed discharge aperture as suggested in FIGS. 6A and 6B.

Cap body 230 of dispensing cap 216 includes an annular side wall 252 arranged to surround filler neck 246 when closure 214 is mounted on filler neck 246 and a top wall 254 coupled to an outer end of annular side wall 252 as shown, for example, in FIG. 6. Side and top walls 252, 254 cooperate to form a boundary of neck-receiving cavity 234. Top wall 254 is formed to include an interior edge 242 bordering an opening into the discharge passageway 236 formed in product-discharge spout 232 as suggested in FIGS. 5 and 6. Top wall 254 is arranged to surround interior edge 242 and mate with pliable membrane 220 of flow control valve 218 to place the normally closed discharge aperture 222 in fluid communication with neck-receiving cavity 234 of cap body 230 and discharge passageway 236 of product-discharge spout 232. In one example, top wall 254 of cap body 230 is substantially flat and extends between and interconnects side wall 252 and product-discharge spout 232 as shown in FIG. 6.

Product-discharge spout 232 of dispensing cap 216 includes a base 37 and a tip 38 as suggested in FIG. 6. Base 237 is coupled to an upper part of cap body 230 and tip 238 is coupled to an upper part of base 237. As suggested in FIG. 6, cap body 230 has a diameter and product-discharge spout has a length. In one example, a ratio of diameter to length is greater than about 5. In another example, the ratio is greater than about 7. In another example, the ratio is greater than 10. In still yet another example, the ratio is about 11. The ratio provides an indicator of whether the product-discharge spout is relatively long or relatively short as shown in FIG. 6.

During use, flow control valve 218 moves between the normally closed position and a pressurized open position in which pressurized fluid material 11 is permitted to be communicated from interior product-storage region 223, through normally closed discharge aperture 222 and into discharge passageway 236. When flow control valve 218 is in the pressurized open position, a portion of flow control valve 218 is arranged to extend toward and into discharge passageway 236.

In use, when container 212 is squeezed as suggested by double arrows F to pressurize interior region 23 of container 212 of package 210. As a result, fluid material 11 flows outwardly toward tip 238 of product-discharge spout 232 to open the normally closed discharge aperture 222 formed in pliable membrane 220 of flow control valve 218 and defined by slits 224, 226. This expelled fluid material 11 then flows through discharge passageway 236 to exit closure 14 into the atmosphere surrounding package 210.

Figure 6A:
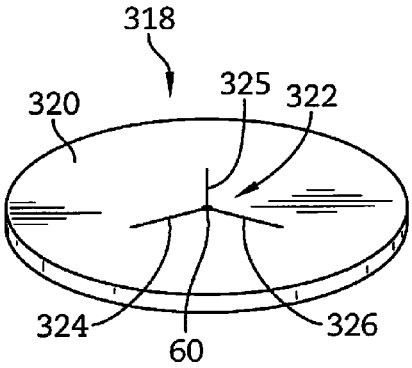
FIG. 6A is a perspective view of the flow control valve of FIG. 6 showing that the flow control valve is formed to include an aperture defined by three slits of substantially similar length and arranged to extend away from a center point of the pliable membrane at about equal circumferential distances from one another.
Figure 6B:
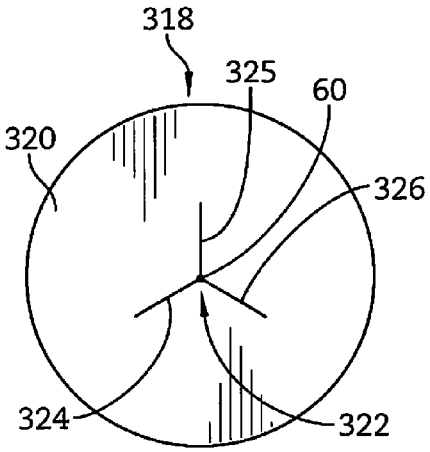
FIG. 6B is a top plan view of the flow control valve of FIG. 6A.

A package 310 includes a container 212, and a closure 314 comprising a dispensing cap 216 and a flow control valve 318 is suggested in FIGS. 6-6B. Flow control valve 318 is a pliable membrane 320 made of film and formed to include a normally closed discharge aperture 322 defined by three intersecting slits 324, 325, 326 as suggested in FIGS. 6A and 6B. Normally closed discharge aperture 322 formed in pliable membrane 320 is configured to provide means for regulating flow of fluid material 11 from the interior region 223 of container 212 into discharge passageway 236 formed closure 314 through normally closed discharge aperture 322 in the event container 212 is squeezed to pressurize fluid material 11 stored in interior region 223 of container 212.

In one example, first, second, and third slits 324, 325, 326 begin at center point 60 of pliable membrane 320 and extend outwardly from center point 60 as suggested in FIGS. 6A and 6B. Each slit 324, 325, 326 have relatively the same length and distal ends of each slit 324, 325, 326 are spaced apart about the same distance from each neighboring circumferential slit.

Another embodiment of a flow control valve 618 in accordance with the present disclosure is shown diagrammatically in FIG. 9. Flow control valve 618 includes a pliable membrane 620 formed to include a normally closed discharge aperture 622 defined, for example, by one or more slits. Pliable membrane 620 is pre-formed to include a domed center portion 620D surrounded by a ring-shaped perimeter portion 620P. Perimeter portion 620P includes a ring-shaped side wall 620PS arranged to surround domed center portion 620D and a ring-shaped top wall 620PT arranged to interconnect upper edges of side wall 620PS and domed center portion 620PT.

Domed center portion 620D of flow control valve 618 is formed to include the normally closed discharge aperture 622. A downwardly facing surface of domed center portion 620D has a normally convex shape as shown in solid in FIG. 9 and faces toward the underlying container. When exposed to underside pressure extant in the container, then the domed center portion 620D is deformed elastically to move upwardly past an over center position to assume a new shape in which the downwardly facing surface of domed center portion 620D now has a concave shape as suggested in phantom in FIG. 8.

A flow control valve 718 in accordance with another embodiment of the present disclosure is shown in FIG. 10. In this embodiment, the domed center portion 720D is similar in structure and function to domed center portion 620D. However, in this embodiment, the surrounding perimeter portion 720P is substantially flat.

A package 410 includes a container 412, and a closure 414 comprising a dispensing cap 416 and a flow control valve 418 is suggested in FIGS. 11 and 12. Flow control valve 418 is a pliable membrane 420 made of film and formed to include a normally closed discharge aperture 422 defined by a pair of intersecting slits 424, 426 as suggested in FIGS. 12 and 14. Normally closed discharge aperture 422 formed in pliable membrane 420 is configured to provide means for regulating flow of fluid material 11 from the interior region 423 of container 412 into a discharge passageway 436 formed closure 414 through normally closed discharge aperture 422 in the event container 412 is squeezed to pressurize fluid material 11 stored in interior region 423 of container 412.

In one example, first and second slits 424, 426 are arranged to extend through a center point 60 of pliable membrane 420 as suggested in FIGS. 12 and 14. As shown in FIG. 14, first slit 424 and second slit 426 have about the same length and are arranged to establish a plus-sign shape.

Container 412 includes a container body 444 and a filler neck 446 coupled to container body 444 in an illustrative embodiment shown in FIGS. 11, 12, and 13. Container body 444 and filler neck 446 cooperate to form an interior region 423 of container 412. A mouth 448 formed in filler neck 446 opens into interior region 423. Threads 450, or other suitable closure retainers, are coupled to filler neck 446 and configured to mate with closure 414 to retain closure 414 in a mouth-closing position on filler neck 446 as suggested in FIGS. 12 and 13.

Dispensing cap 416 includes a cap body 430 adapted to be coupled to filler neck 446 and a product-discharge spout 432 coupled to cap body 430 as suggested in FIG. 13. Cap body 430 is formed to include a neck-receiving cavity 434 sized to receive a portion of filler neck 446 therein when closure 414 is mounted on filler neck 446. Product-discharge spout 432 is formed to include discharge passageway 436 as shown suggested in FIGS. 11, 12, and 13. In an illustrative embodiment, pliable membrane 420 is located in neck-receiving cavity 434 and coupled to cap body 430 to move therewith relative to filler neck 446. For example, when cap body 430 is separated from filler neck 446, pliable membrane is retained with cap body 430.

Cap body 430 of dispensing cap 416 includes an annular side wall 452 arranged to surround filler neck 446 when closure 414 is mounted on filler neck 446 and a top wall 454 coupled to an outer end of annular side wall 452 as shown, for example, in FIG. 13. Side and top walls 452, 454 cooperate to form a boundary of neck-receiving cavity 434. Top wall 454 is formed to include an interior edge 442 bordering an opening into the discharge passageway 436 formed in product-discharge spout 432 as suggested in FIG. 13. Top wall 454 is arranged to surround interior edge 442 and mate with pliable membrane 420 of flow control valve 218 to place the normally closed discharge aperture 422 in fluid communication with neck-receiving cavity 434 of cap body 430 and discharge passageway 436 of product-discharge spout 432. In one example, top wall 454 of cap body 430 is substantially flat and extends between and interconnects side wall 452 and product-discharge spout 432 as shown in FIG. 13.

Product-discharge spout 432 of dispensing cap 416 includes a base 437 and a tip 438 as suggested in FIG. 13. Base 437 is coupled to an upper part of cap body 430 and tip 438 is coupled to an upper part of base 437. As suggested in FIG. 13, cap body 430 has a diameter and product-discharge spout has a length. In one example, a ratio of diameter to length is less than about 5. In another example, the ratio is less than about 3. In another example, the ratio is greater than less 2. In still yet another example, the ratio is less than about 1. The ratio provides an indicator of whether the product-discharge spout is relatively short or relatively long as shown in FIGS. 11, 12, and 13

During use, flow control valve 418 moves between the normally closed position and a pressurized open position in which pressurized fluid material 11 is permitted to be communicated from interior product-storage region 423, through normally closed discharge aperture 422 and into discharge passageway 436. When flow control valve 418 is in the pressurized open position, a portion of flow control valve 418 is arranged to extend toward and into discharge passageway 436.

In use, when container 412 is squeezed to pressurize interior region 423 of container 412 of package 410, the increased pressure causes fluid material 11 to flow outwardly toward tip 438 of product-discharge spout 432 to open the normally closed discharge aperture 422 formed in pliable membrane 420 of flow control valve 418 and defined by slits 424, 426. This expelled fluid material 11 then flows through discharge passageway 436 to exit closure 414 into the atmosphere surrounding package 410.

Various embodiments of dispensing caps 516A, 516B, 516C, 516D, 516E, 516F are shown, for example, in FIGS. 19-24. Dispensing caps 516A, 516B are considered to have relatively long product-discharge spouts while dispensing caps 516E, 516F are considered to have relatively short product-discharge spouts. Dispensing caps 516C, 516D are considered to have intermediate length product-discharge spouts.

A variety of slit formations can be used in accordance with the normally closed discharge aperture disclosed herein. Several examples are shown in FIGS. 25-68.

A flow control valve in accordance with the present disclosure may include a pliable or semi-rigid membrane made of film that is sealed, slit, or scored. The flow control valve may be anchored either to a container or to a container closure. In one example, a roller die cut is used to form one or more slit patterns in the membrane. In another example, a laser is used to form one or more slit patterns in the membrane. As a result of forming one or more slit patterns in the membrane, cost of manufacture is minimized as manufacturing complexity is minimized.

A flow control valve in accordance with the present disclosure is well-suited for use in inverted condiment and general fluid dispensing applications. In another example, flow control valves in accordance with the present disclosure may be made from a predominantly stiff polymeric material such as polyethylene terephthalate (PET), Nylon, polycarbonate (PC), acrylonitrile butadiene styrene (ABS), polypropylene, polyester, mixtures thereof, laminates thereof, or any other suitable alternatives. The stiffness of the predominantly stiff polymeric material provides areas between the slits to act as springs which resist the flow of fluid materials and urge the flow control valve to return to the normally closed arrangement. The predominantly stiff materials may also be cold formed.

In still yet another example, flow control valves in accordance with the present disclosure may be made from a relatively softer polymeric material such as a thermoplastic elastomer (TPE). In such applications where TPE is used, the film may be thicker with varied slit patterns to compensate for reductions in stiffness.

Some configuration of closures may be suited for use with relatively low viscosity fluids. In one example, low viscosity fluids have a viscosity less than about 1,500 centipoise. In another example, low viscosity fluids have a viscosity less than about 1,000 centipoise. In another example, low viscosity fluids have a viscosity less than about 100 centipoise. In another example, low viscosity fluids have a viscosity of about 1 centipoise.

The configuration used for low viscosity fluids includes the apertures shown in FIGS. 2, 2A, 3A, 3B, three layer film 20A, and dispensing caps having relatively long product-discharge spouts like those shown in FIGS. 1, 2, 3, 11, 12, 13, 19 and 20. Relatively long dispensing caps having a relatively thin directional discharge passageway formed therein may be used direct the flow of the fluid material.

Some configurations of closure may be suitable for use with relatively high viscosity fluids. In one example, high viscosity fluids have a viscosity greater than about 1,500 centipoise. In another example, high viscosity fluids have a viscosity greater than about 100,000 centipoise. For example, the configuration used for high viscosity fluids includes the apertures of FIGS. 5, 5A, 6A, 6B, 7, 8, 14, and 26, monolayer polypropylene film 20D having a thickness of about 10 mil to about 15 mil, and relatively short product-discharge spouts like those shown in FIGS. 4, 5, 6, 23, and 24

The orifice established by an opened discharge aperture is expected to be from about 1/16 inch to about ½ inch. However, any other suitable dimensions may be used.

A flow control valve in accordance with the present disclosure is made from a film. The flow control valve is coupled to one of the container and the discharge cap. The flow control valve is arranged to lie between the dispensing cap and the container and formed to include a normally-closed discharge aperture in fluid communication with the interior product-storage region of the container and with the discharge passageway of the closure.

The flow control valve is configured to provide means for regulating flow of fluid material having a viscosity from the interior product-storage region of the container into the discharge passageway through the normally closed discharge aperture in response to squeezing the container to apply pressure to the fluid material stored in the interior region of the container while blocking leaks or dribbles of fluid material from moving through the normally closed aperture when the container is arranged to cause the closure to be located between ground underlying the package and the container including fluid material stored therein and when squeezing has ceased and no more pressure is applied to the fluid material.

In one example, a package in accordance with the present disclosure may be used for a low viscosity application. One example of a low viscosity application is a water/beverage enhancer application. In this application, the combination of dispensing cap shape, normally closed discharge aperture shape, and film configuration should be chosen so as to provide a tight stream or jet of fluid material that penetrates deeply into the water/beverage to maximize mixing of the beverage enhancer with the water/beverage in response to squeezing the container.

In another example, a package in accordance with the present disclosure may be used for a different low viscosity application. Another example of a low viscosity application is an eye drop application. In this application, the combination of dispensing cap shape, normally closed discharge aperture shape, and film configuration should be chosen so as to provide one or more discrete drops of emitted from the package in response to squeezing the container or inverting the container. As a result, flow rate may be configured to supply a certain amount of eye drop fluid over a given period of time.

In one example, a package in accordance with the present disclosure may be used for a high viscosity application. One example of a high viscosity application is a food condiment such as mustard or ketchup. In this application, the combination of dispensing cap shape, normally closed discharge aperture shape, and film configuration should be chosen so as to provide a low-pressure stream of fluid material that minimizes splatter but provides desired volume flow rate of the fluid material all while leaving a relatively clean out surface of the flow control valve.

The following numbered clauses include embodiments that are contemplated and non-limiting:

Clause 1. A package comprising a container formed to include an interior product-storage region and an opening arranged to open into the interior product-storage region, a dispensing cap formed to include a discharge passageway and coupled to a neck included in the container and, a flow control valve coupled to the container to lie between the dispensing cap and the container and formed to include a normally-closed discharge aperture in fluid communication with the interior product-storage region of the container and with the discharge passageway of the closure, wherein the flow control valve is made from a film and configured to provide means for regulating flow of fluid material from the interior product-storage region of the container into the discharge passageway of the dispensing cap through the normally closed discharge aperture in the event the container is squeezed to pressurize fluid material stored in the interior region of the container.

Clause 2. A package comprising a container formed to include an interior product-storage region and an opening arranged to open into the interior product-storage region, a dispensing cap formed to include a discharge passageway and coupled to a neck included in the container and, a flow control valve made from a film and coupled to the container to lie between the dispensing cap and the container and formed to include a normally-closed discharge aperture in fluid communication with the interior product-storage region of the container and with the discharge passageway of the closure, the flow control valve being configured to provide means for regulating flow of fluid material having a viscosity from the interior product-storage region of the container into the discharge passageway through the normally closed discharge aperture in response to squeezing the container to pressurize fluid material stored in the interior region of the container so that an upper surface of the flow control valve remains clean after the flow fluid material has stopped.

Clause 2. The package of any other clause, wherein the flow control valve has a normally closed arrangement in which the flow control valve includes a perimeter edge arranged to mate with the container and closure and a center portion formed to include the normally closed discharge aperture.

Clause 3. The package of any other clause, wherein the center portion of the flow control valve has a convex surface arranged to face downwardly toward the interior product-storage region of the container when the flow control valve is in the normally closed arrangement.

Clause 4. The package of any other clause, wherein the center portion of the flow control valve moves from the normally closed arrangement to a pressurized open arrangement in response to pressurizing the interior product-storage region.

Clause 5. The package of any other clause, wherein the center portion has a concave surface facing downwardly towards the interior product-storage region of the container when the flow control valve is in the pressurized open arrangement.

Clause 6. The package of any other clause, wherein the film includes an upper layer arranged to lie between the dispensing cap and the container and a core layer located between the upper layer and the container.

Clause 7. The package of any other clause, wherein the upper layer is made from a first polymeric material and the core layer is made from a different second polymeric material.

Clause 8. The package of any other clause, wherein the first polymeric material includes a polypropylene material and the different second polymeric material includes a polyester material.

Clause 9. The package of any other clause, wherein the film includes a lower layer arranged to lie between the dispensing cap and the container and a core layer located between the lower layer and the dispensing cap.

Clause 10. The package of any other clause, wherein the lower layer is made from a first polymeric material and the core layer is made from a different second polymeric material.

Clause 11. The package of any other clause, wherein the first polymeric material includes a polypropylene material and the different second polymeric material includes a polyester material.

Clause 12. The package of any other clause, wherein the film includes an upper layer arranged to lie between the dispensing cap and the container, a bottom layer spaced apart from the upper layer and located between the upper layer and the container, and a core layer located between the upper and lower layers.

Clause 13. The package of any other clause, wherein the upper layer is made from a first polymeric material and the core layer is made from a different second polymeric material.

Clause 14. The package of any other clause, wherein the bottom layer is made from the first polymeric material.

Clause 15. The package of any other clause, wherein the first polymeric material is a polypropylene material.

Clause 16. The package of any other clause, wherein the different second polymeric material includes a polyester material.

Clause 17. The package of any other clause, wherein the bottom layer is made from a first polymeric material and the core layer is made from a different second polymeric material.

Clause 18. The package of any other clause, wherein the first polymeric material includes a polypropylene material and the different second polymeric material includes a polyester material.

Clause 19. The package of any other clause, wherein the upper layer is made from a first polymeric material, the core layer is made from a different second polymeric material, and the bottom layer is made from the first polymeric material and the core layer has a thickness of about 4 mil to about 5 mil.

Clause 20. The package of any other clause, wherein the upper layer has a thickness of about 1 mil.

Clause 21. The package of any other clause, wherein the bottom layer has a thickness of about 1 mil.

Clause 22. The package of any other clause, wherein the film has a thickness of about 6 mil to about 7 mil.

Clause 23. The package of any other clause, wherein the film is a monolayer material.

Clause 24. The package of any other clause, wherein the monolayer material includes a polyester material.

Clause 25. The package of any other clause, wherein the monolayer material is a polypropylene material.

Clause 26. The package of any other clause, wherein the film has a thickness of about 10 mil to about 15 mil.

Clause 27. The package of any other clause, wherein the aperture is defined by a first slit and a second slit.

Clause 28. The package of any other clause, wherein the first slit is arranged to extend through a center point of the flow control valve and the second slit is arranged to extend through the center point.

Clause 29. The package of any other clause, wherein a length of the first slit and the second slit is about the same.

Clause 30. The package of any other clause, wherein the first slit has a length and the second slit has a relatively smaller second length.

Clause 31. The package of any other clause, wherein the aperture is defined by a single slit.

Clause 32. The package of any other clause, wherein the aperture is arranged to extend through a center point of the flow control valve.

Clause 33. The package of any other clause, wherein the aperture is defined by a first slit, a second slit, and a third slit.

Clause 34. The package of any other clause, wherein the first, second, and third slits are arranged to extend through a center point of the flow control valve.

Clause 35. The package of any other clause, wherein the first, second, and third slits are arranged to extend away from one another.

Clause 36. The package of any other clause, wherein each slit has a distal end that is spaced apart from each neighboring distal end about an equal distance.

Clause 37. The package of any other clause, wherein the dispensing cap includes a cap body coupled to the filler neck of the container and formed to include a neck-receiving cavity sized to receive the filler neck therein and a product-discharge spout coupled to the cap body to extend away from the container and formed to include the discharge passageway therein and the flow control valve is located in the neck-receiving cavity.

Clause 38. The package of any other clause, wherein the cap body includes side wall arranged to surround the filler neck and a top wall coupled to side wall to extend between and interconnect the side wall and the product-discharge spout and the side wall and the top wall cooperate to define a boundary of the neck-receiving cavity.

Clause 39. The package of any other clause, wherein the top wall is substantially flat between the product-discharge spout and the side wall.

Clause 40. The package of any other clause, wherein the flow control valve has a normally closed position in which fluid communication between the discharge passageway and the mouth of the container is blocked and a pressurized open portion in which fluid communication between the discharge passageway and the mouth of the container is permitted and a portion of the flow control valve is arranged to extend out of the neck-receiving cavity and into the discharge passageway.

Clause 41. The package of any other clause, wherein the product-discharge spout includes a base coupled to the top wall and arranged to extend away from the top wall and a tip coupled to the base to locate the base between the tip and the top wall and the discharge passageway includes a lower section defined by the base and an upper section defined by the tip.

Clause 42. The package of any other clause, wherein the portion of the flow control valve extends into the lower section when the flow control valve is in the pressurized open position.

Clause 43. The package of any other clause, wherein the top wall includes a flat outer portion coupled to the side wall and arranged to extend toward the product-discharge spout and a convex portion arranged to extend out away from the container and between and interconnect the flat outer portion and the product-discharge spout to locate the product-discharge spout in axially spaced-apart relation to the flat outer portion of the top wall.

Clause 44. The package of any other clause, wherein the flow control valve has a normally closed position in which fluid communication between the discharge passageway and the mouth of the container is blocked and a pressurized open portion in which fluid communication between the discharge passageway and the mouth of the container is permitted and the flow control valve is located in the neck-receiving cavity when in the pressurized open position.

Clause 45. The package of any other clause, the neck-receiving cavity includes an upper portion defined in part by the flow control valve when the flow control valve is in the normally closed position and in part by the convex portion or the top wall and a lower portion defined in part by the flat outer portion and the side wall.

Clause 46. The package of any other clause, wherein the flow control valve is located in the lower portion of the neck-receiving cavity when the flow control valve is in the normally closed position and a portion of the flow control valve extends out of the lower portion into the upper portion when the flow control valve is in the pressurized open position.

Clause 47. The package of any other clause, wherein the viscosity is less than about 1,500 centipoise.

Clause 48. The package of any other clause, wherein the viscosity is less than about 1,000 centipoise.

Clause 49. The package of any other clause, wherein the viscosity is less than about 100 centipoise.

Clause 50. The package of any other clause, wherein the viscosity is about 1 centipoise.

Clause 51. The package of any other clause, wherein the film includes an upper layer arranged to lie between the dispensing cap and the container, a bottom layer spaced apart from the upper layer and located between the upper layer and the container, and a core layer located between the upper and lower layers.

Clause 52. The package of any other clause, wherein the aperture is defined by a slit arranged to extend through a center point of the flow control valve and having a linear shape.

Clause 53. The package of any other clause, wherein the aperture is defined by a first slit arranged to extend through a center point of the flow control valve and a second slit is arranged to extend through the center point.

Clause 54. The package of any other clause, wherein the first slit has a length and the second slit has a relatively smaller second length.

Clause 55. The package of any other clause, wherein the dispensing cap includes a cap body coupled to the filler neck of the container and formed to include a neck-receiving cavity sized to receive the filler neck therein and a product-discharge spout coupled to the cap body to extend away from the container and formed to include the discharge passageway therein and the flow control valve is located in the neck-receiving cavity, the cap body has an outer diameter, the product-discharge spout has a length, and a ratio of diameter to length is less than about 5.

Clause 56. The package of any other clause, wherein the ratio is less than about 3.

Clause 57. The package of any other clause, wherein the ratio is about 2.

Clause 58. The package of any other clause, wherein the viscosity is greater than about 1,500 centipoise.

Clause 59. The package of any other clause, wherein the viscosity is greater than about 100,000 centipoise.

Clause 60. The package of any other clause, wherein the viscosity is greater than about 250,000 centipoise.

Clause 61. The package of any other clause, wherein the film is a monolayer material.

Clause 62. The package of any other clause, wherein the film includes polypropylene.

Clause 63. The package of any other clause, wherein the film has a thickness of about 10 mil to about 15 mil.

Clause 64. The package of any other clause, wherein the aperture is defined by a first slit arranged to extend through a center point of the flow control valve and a second slit arranged to extend through the center point.

Clause 65. The package of any other clause, wherein a length of the first slit is about equal to a length of the second slit.

Clause 66. The package of any other clause, wherein the aperture is defined by a first slit, a second slit, and a third slit and each of the slits is arranged to extend from a center point of the flow control valve toward a perimeter of the flow control valve.

Clause 67. The package of any other clause, wherein each slit has a distal end that is spaced apart from each neighboring distal end about an equal distance.

Clause 68. The package of any other clause, wherein the dispensing cap includes a cap body coupled to the filler neck of the container and formed to include a neck-receiving cavity sized to receive the filler neck therein and a product-discharge spout coupled to the cap body to extend away from the container and formed to include the discharge passageway therein and the flow control valve is located in the neck-receiving cavity, the cap body has an outer diameter, the product-discharge spout has a length, and a ratio of diameter to length is greater than about 5.

Clause 69. The package of any other clause, wherein the ratio is greater than about 8.

Clause 70. The package of any other clause, wherein the ratio is greater than about 10.

Clause 71. A package comprising a container formed to include an interior product-storage region and an opening arranged to open into the interior product-storage region, a dispensing cap formed to include a discharge passageway and coupled to a neck included in the container and, a flow control valve made from a film and coupled to the container to lie between the dispensing cap and the container and formed to include a normally-closed discharge aperture in fluid communication with the interior product-storage region of the container and with the discharge passageway of the closure, the flow control valve being configured to provide means for regulating flow of fluid material having a viscosity from the interior product-storage region of the container into the discharge passageway through the normally closed discharge aperture in response to squeezing the container to apply pressure to the fluid material stored in the interior region of the container while blocking leaks or dribbles of fluid material from moving through the normally closed aperture when the container is arranged to cause the closure to be located between ground underlying the package and the container including fluid material stored therein and when squeezing has ceased and no more pressure is applied to the fluid material.

The invention claimed is:

1. A package comprising a container formed to include an interior product-storage region and an opening arranged to open into the interior product-storage region, a dispensing cap formed to include a discharge passageway and coupled to a neck included in the container and, a flow control valve coupled to the container to lie between the dispensing cap and the container and formed to include a normally-closed discharge aperture in fluid communication with the interior product-storage region of the container and with the discharge passageway of the dispensing cap, wherein the flow control valve is made from a film and configured to provide means for regulating flow of fluid material from the interior product-storage region of the container into the discharge passageway of the dispensing cap through the normally closed discharge aperture in the event the container is squeezed to pressurize fluid material stored in the interior region of the container, wherein the film includes an upper layer arranged to lie between the dispensing cap and the container and a core layer located between the upper layer and the container, wherein the film further includes a lower layer located between the core layer and the container, wherein the upper layer is made from a first polymeric material, the core layer is made from a different second polymeric material.

2. A package comprising a container formed to include an interior product-storage region and an opening arranged to open into the interior product-storage region, a dispensing cap formed to include a discharge passageway and coupled to a neck included in the container and, a flow control valve coupled to the container to lie between the dispensing cap and the container and formed to include a normally-closed discharge aperture in fluid communication with the interior product-storage region of the container and with the discharge passageway of the dispensing cap, wherein the flow control valve is made from a film and configured to provide means for regulating flow of fluid material from the interior product-storage region of the container into the discharge passageway of the dispensing cap through the normally closed discharge aperture in the event the container is squeezed to pressurize fluid material stored in the interior region of the container, wherein the film includes an upper layer arranged to lie between the dispensing cap and the container and a core layer located between the upper layer and the container, wherein the film further includes a lower layer located between the core layer and the container, wherein the upper layer is made from a first polymeric material, the core layer is made from a different second polymeric material, and the bottom layer is made from the first polymeric material, the upper layer has a thickness of about 1 mil, the bottom layer has a thickness of about 1 mil, and the core layer has a thickness of about 4 mil to about 5 mil.

3. The package of claim 1, wherein the flow control valve has a normally closed arrangement in which the flow control valve includes a perimeter edge arranged to mate with the container and dispensing cap and a center portion formed to include the normally closed discharge aperture.

4. The package of claim 3, wherein the center portion of the flow control valve has a convex surface arranged to face downwardly toward the interior product-storage region of the container when the flow control valve is in the normally closed arrangement.

5. The package of claim 4, wherein the center portion of the flow control valve moves from the normally closed arrangement to a pressurized open arrangement in response to pressurizing the interior product-storage region and the center portion has a concave surface facing downwardly towards the interior product-storage region of the container when the flow control valve is in the pressurized open arrangement.

6. The package of claim 1, wherein the aperture is defined by a first slit arranged to extend through a center point of the flow control valve and a second slit arranged to extend through the center point of the flow control valve.

7. The package of claim 6, wherein a length of the first slit and the second slit is about the same.

8. The package of claim 6, wherein the first slit has a length and the second slit has a relatively smaller second length.

9. The package of claim 1, wherein the aperture is defined by a single slit arranged to extend through a center point of the flow control valve.

10. The package of claim 1, wherein the aperture is defined by a first slit, a second slit, and a third slit, each slit is arranged to extend from a center point of the flow control valve toward a perimeter of the flow control valve, and each slit has a distal end that is spaced apart from each neighboring distal end about an equal distance.

11. The package of claim 1, wherein the dispensing cap includes a cap body coupled to the filler neck of the container and formed to include a neck-receiving cavity sized to receive the filler neck therein and a product-discharge spout coupled to the cap body to extend away from the container and formed to include the discharge passageway therein and the flow control valve is located in the neck-receiving cavity.

12. The package of claim 11, wherein the cap body includes a side wall arranged to surround the filler neck and a top wall coupled to side wall to extend between and interconnect the side wall and the product-discharge spout and the side wall and the top wall cooperate to define a boundary of the neck-receiving cavity.

13. The package of claim 12, wherein the top wall is substantially flat between the product-discharge spout and the side wall.

14. The package of claim 12, wherein the flow control valve has a normally closed position in which fluid communication between the discharge passageway and the mouth of the container is blocked and a pressurized open portion in which fluid communication between the discharge passageway and the mouth of the container is permitted and a portion of the flow control valve is arranged to extend out of the neck-receiving cavity and into the discharge passageway.

15. The package of claim 14, wherein the product-discharge spout includes a base coupled to the top wall and arranged to extend away from the top wall and a tip coupled to the base to locate the base between the tip and the top wall and the discharge passageway includes a lower section defined by the base and an upper section defined by the tip and the portion of the flow control valve extends into the lower section when the flow control valve is in the pressurized open position.

16. A package comprising a container formed to include an interior product-storage region and an opening arranged to open into the interior product-storage region, a dispensing cap formed to include a discharge passageway and coupled to a neck included in the container and, a flow control valve made from a film having a polymeric layer and a polyester layer and coupled to the container to lie between the dispensing cap and the container and formed to include a normally-closed discharge aperture in fluid communication with the interior product-storage region of the container and with the discharge passageway of the dispensing cap, the flow control valve being configured to provide means for regulating flow of fluid material having a viscosity from the interior product-storage region of the container into the discharge passageway through the normally closed discharge aperture in response to squeezing the container to apply pressure to the fluid material stored in the interior region of the container while blocking leaks of fluid material from moving through the normally closed aperture when the container is arranged to cause the dispensing cap to be located between ground underlying the package and the container and when squeezing has ceased so that no pressure is applied to the fluid material.

17. The package of claim 16, wherein the viscosity is less than about 100 centipoise.

18. The package of claim 16, wherein the viscosity is greater than about 10,000 centipoise.

* * * * *